US007261617B1

(12) United States Patent
Kim et al.

(10) Patent No.: US 7,261,617 B1
(45) Date of Patent: Aug. 28, 2007

(54) SEMICONDUCTOR WAFER REGENERATING SYSTEM AND METHOD

(75) Inventors: Sung-Shin Kim, Cheonan (KR); Sang-Bong Han, Cheonan (KR)

(73) Assignee: Youth Tech Co., Ltd., Cheonan (KR)

( * ) Notice: Subject to any disclaimer, the term of this patent is extended or adjusted under 35 U.S.C. 154(b) by 0 days.

(21) Appl. No.: 11/380,850

(22) Filed: Apr. 28, 2006

(51) Int. Cl.
*B24C 3/04* (2006.01)

(52) U.S. Cl. ..... 451/38; 451/81

(58) Field of Classification Search ..... 451/38, 451/78, 80, 81, 87, 88, 89, 53
See application file for complete search history.

(56) References Cited

U.S. PATENT DOCUMENTS

| | | | | | |
|---|---|---|---|---|---|
| 3,696,565 | A | * | 10/1972 | Claeys | 451/39 |
| 4,561,219 | A | * | 12/1985 | Harada et al. | 451/38 |
| 5,512,005 | A | * | 4/1996 | Gulling | 451/29 |
| 6,113,475 | A | * | 9/2000 | Masuda et al. | 451/76 |
| 6,706,636 | B2 | | 3/2004 | Matsukawa | |
| 2005/0092349 | A1 | | 5/2005 | Suzuki et al. | |

FOREIGN PATENT DOCUMENTS

| | | | | |
|---|---|---|---|---|
| EP | 0002628 | * | 6/1979 | 451/80 |
| GB | 817711 | * | 8/1959 | 451/81 |
| JP | 08-281556 | | 10/1996 | |
| KR | 10-2005-0038728 | | 4/2005 | |
| KR | 10-0545446 | | 1/2006 | |

* cited by examiner

*Primary Examiner*—Robert A. Rose
(74) *Attorney, Agent, or Firm*—Lowe, Hauptman & Berner, LLP

(57) ABSTRACT

A semiconductor wafer regenerating system is capable of easily and efficiently removing fabricating patterns formed on a semiconductor wafer to enable reuse of the semiconductor wafer. The system, which removes patterns of the semiconductor wafer in a dry manner by using blasting grit, includes a mesh conveyor, a grit blaster, a swinging element, a collecting element, a separating element, and a dust collector. The mesh conveyor transports the semiconductor wafer so that the patterns face upward. The grit blaster is installed above the mesh conveyor and has at least one blasting nozzle for blasting grits toward the semiconductor wafer to remove the patterns from the semiconductor wafer. The swinging element swings the blasting nozzle in a plane perpendicular to a transporting path of the semiconductor wafer along the mesh conveyor. The collecting element underneath the mesh conveyor collects pulverulent bodies including grits, chips, and dusts falling from the mesh conveyor. The separating element is connected to the collecting element to separate the grits and chips from the dusts. The dust collector is connected to the separating element to collect the dusts separated by the separating element.

20 Claims, 16 Drawing Sheets

SEMICONDUCTOR WAFER REGENERATING SYSTEM AND METHOD

BACKGROUND OF THE INVENTION

1. Field of the Invention

The present invention relates to a semiconductor wafer regenerating system and method and, more specifically, to a system and method for removing patterns formed on a semiconductor wafer to enable the reuse of the semiconductor wafer.

2. Description of Related Arts

Semiconductor integrated circuit (IC) chips being present in everyday electrical and electronic devices are created through a multiple-step sequence of photographic and chemical processing steps, during which electronic circuits are gradually created on a wafer made of pure semiconductor material. Reviewing the semiconductor device fabrication in more detail, extremely pure semiconductor material (e.g., silicon) is grown into mono-crystalline cylindrical ingots, and the ingots are then sliced into wafers about 0.75 mm thick and polished to obtain a very flat surface. Once the wafers are prepared, transistors are formed on the silicon water using various processing steps, e.g., chemical vapor deposition, etching, photolithography, and diffusion and/or ion implantation. After the various semiconductor devices have been created, they are interconnected to form the desired electrical circuits by metal interconnecting wires.

Considering the highly serialized nature of wafer processing, between the various processing steps, wafer tests are performed to verify that the wafer is still good and haven't been damaged by previous processing steps. If the number of die (i.e., a potential chip portion) on a wafer that measure as fails exceed a predetermined threshold, the wafer is discarded rather than invest in further processing. On the other hand, after the metal interconnections are completed, the semiconductor devices are subjected to a variety of electrical tests to determine if they function properly. The device test is carried out using tiny probes, which marks bad chips with a drop of dye. In case that the yield which represents the proportion of devices on the wafer found to perform properly is high enough, the wafer is broken into individual dice, each of which is bonded on a lead frame and packaged. If, however, the yield is below a predetermined threshold, the wafer is discarded.

The discarded wafers which failed to pass the wafer test or device test retains circuit patterns and cannot be used for another purpose, and thus are typically crushed into pieces and scrapped under the ground. Such disposal of discarded wafers results in waste of expensive resources, wafer, and may bring about environment contamination. Accordingly, a method for recycling the discarded wafers is strongly needed.

Some attempts have been made for recycling the discarded wafers. For example, U.S. Pat. No. 6,706,636 issued 16 Mar. 2004 to Renesas Technology Corp. and entitled METHOD OF REGENERATING SEMICONDUCTOR WAFER discloses a method of regenerating a semiconductor wafer using mixed acids. According to this method, a wafer is polished and then immersed in mixed acids. Afterwards, a surface treatment is performed on the wafer to planarize the surface of the wafer, and then a high temperature annealing process is performed to ultimately obtain a regenerate wafer. However, the disclosed method may be inefficient in that not so few process steps are involved in the regenerating process, which makes this method time-consuming. Further, simply polishing and immersing the wafer in mixed acids cannot guarantee the complete removal of ion-implanted region showing physical characteristics different from that of pure silicon and trenches deeply formed into the surface. Besides, the use of several kinds of acids increases the cost for regenerating the wafer.

U.S. Patent Application Publication No. US2005/0092349 published 5 May 2005 and entitled METHOD OF RECLAIMING SILICON WAFERS discloses a method of regenerating a semiconductor wafer through consecutive steps of etching, polishing, and heat-treatment. Among the various steps, this attempt is focused on the heat-treatment of the wafer for 20 minutes-5 hours. As a result, this method may be much more time-consuming and inefficient.

As mentioned above, the conventional methods show low productivity in regenerating semiconductor wafers and are costly due to the use of a large quantity of chemicals and abrasives. Thus, the prior art wafer regenerating techniques provide little benefit from the economic point of view.

SUMMARY OF THE INVENTION

To solve the problems above, one object of the present invention to provide a semiconductor wafer regenerating system capable of easily and efficiently removing fabricated patterns formed on a semiconductor wafer to enable the reuse of the semiconductor wafer.

Another object of the present invention to provide a method for easily and efficiently removing fabricated patterns formed on a semiconductor wafer to enable the reuse of the semiconductor wafer.

The semiconductor wafer regenerating system for achieving one of the above objects removes patterns of semiconductor wafer in a dry manner by blasting grits onto a surface of the semiconductor wafer.

The system includes a mesh conveyor, a grit blaster, swinging means, collecting means, separating means, and a dust collector. The mesh conveyor transports the semiconductor wafer in a condition that the patterns are faced in an upward direction. The grit blaster is installed above the mesh conveyor and has at least one blasting nozzle for blasting grits toward the surface of the semiconductor wafers to remove the patterns from the semiconductor wafer. The swinging means swings the blasting nozzle in a plane perpendicular to a transporting path of the semiconductor wafer along the mesh conveyor. The collecting means is provided underneath the mesh conveyor and collects pulverulent bodies including grits, chips, and dusts falling from the mesh conveyor. The separating means is connected to the collecting means to separate the grits and chips from the dusts. The dust collector is connected to the separating means to collect the dusts separated by the separating means.

Preferably, the grits blasted onto the surface of the semiconductor wafer is recycled after separated by the separating means, which makes the overall process cost-effective.

Preferably, the semiconductor wafer is automatically fed onto the mesh conveyor by a de-stacker.

According to the semiconductor wafer regenerating method for achieving another one of the above objects, the semiconductor wafer is first baked so that moisture and a protective film coated on the semiconductor wafer is removed. Subsequently, the semiconductor wafer is put on a mesh conveyor and transported in a condition that the patterns are faced in an upward direction. While the semiconductor wafer is being transported on the mesh conveyor, grits are blasted onto the surface of the semiconductor wafer to remove the patterns from the semiconductor wafer by use of a grit blaster having at least one blasting nozzle. At this moment, the blasting nozzle swings across the transporting path of the wafer in order to facilitate uniform blasting. Afterwards, pulverulent bodies including grits, chips, and dusts falling from the mesh conveyor are collected under the mesh conveyor. The grits and chips are separated from the dusts to be recirculated to the grit blaster.

According to the present invention, it is possible to remove the circuit patterns formed in the semiconductor wafer in a simple, rapid, and efficient manner, thus regenerating the semiconductor wafer. The semiconductor wafer regenerated by the present invention can be used in applications which requires less planarity and purity of the wafer than the integrated circuits: e.g., the fabrication of solar cells or the like. Since the patterns of the silicon wafer is removed in a dry method of using a grit blasting technique, the present invention makes it possible to easily treat pulverulent bodies (P) such as chips and dusts produced in the pattern removal process. This allows the grits and chips to be reused, which makes the pattern removal process cost-effective. In addition, the silicon wafer can be supplied to the grit blaster in an automated fashion, which helps to increase the yield rate to a great extent.

BRIEF DESCRIPTION OF THE DRAWINGS

The above and other objects, features and advantages of the present invention will become more apparent by describing in detail preferred embodiments thereof with reference to the attached drawings in which.

DESCRIPTION OF THE PREFERRED EMBODIMENTS

Figure 1:
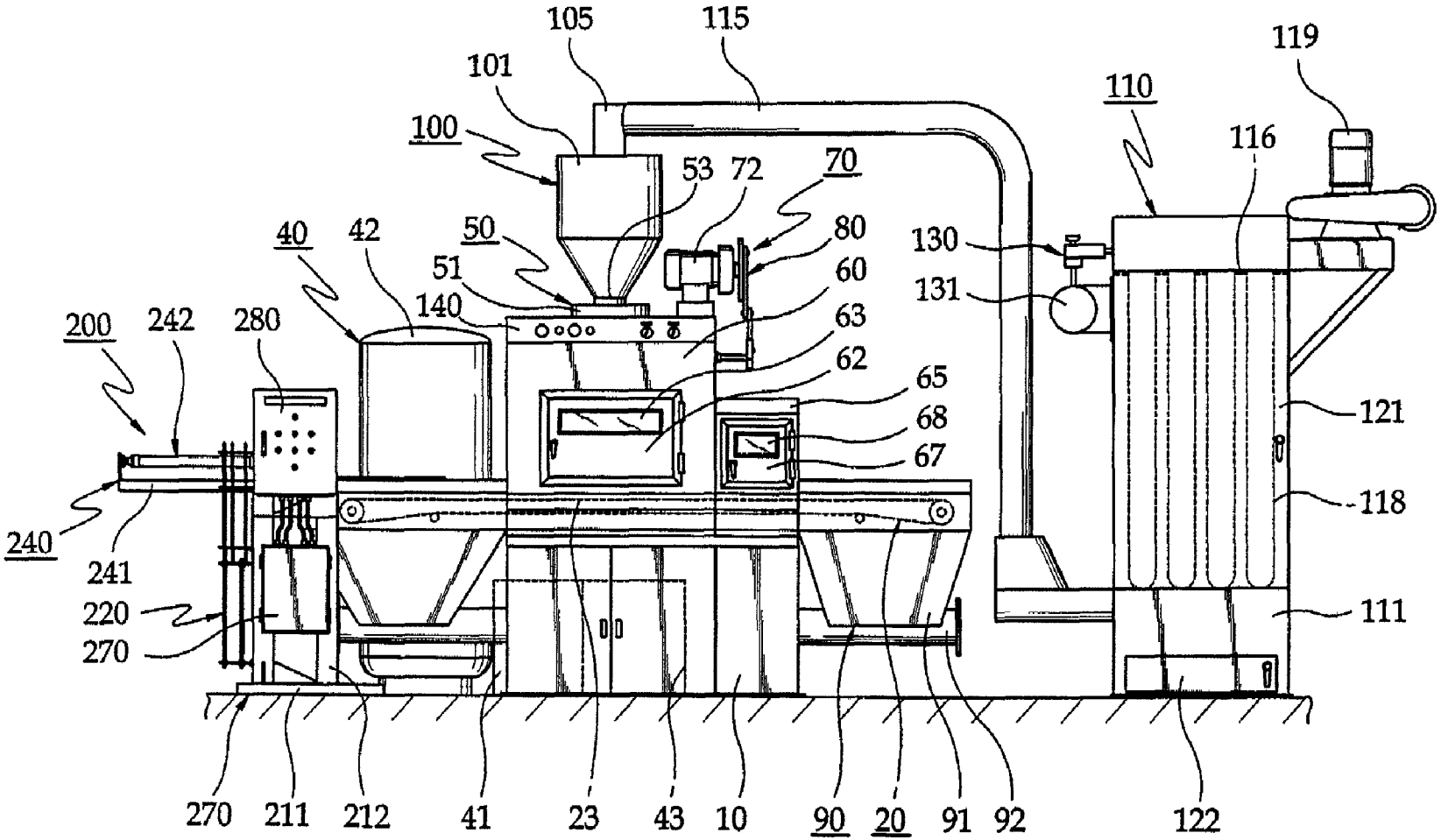
FIG. 1 is a front elevational view of a semiconductor wafer regenerating system according to a preferred embodiment of the present invention.
Figure 2:
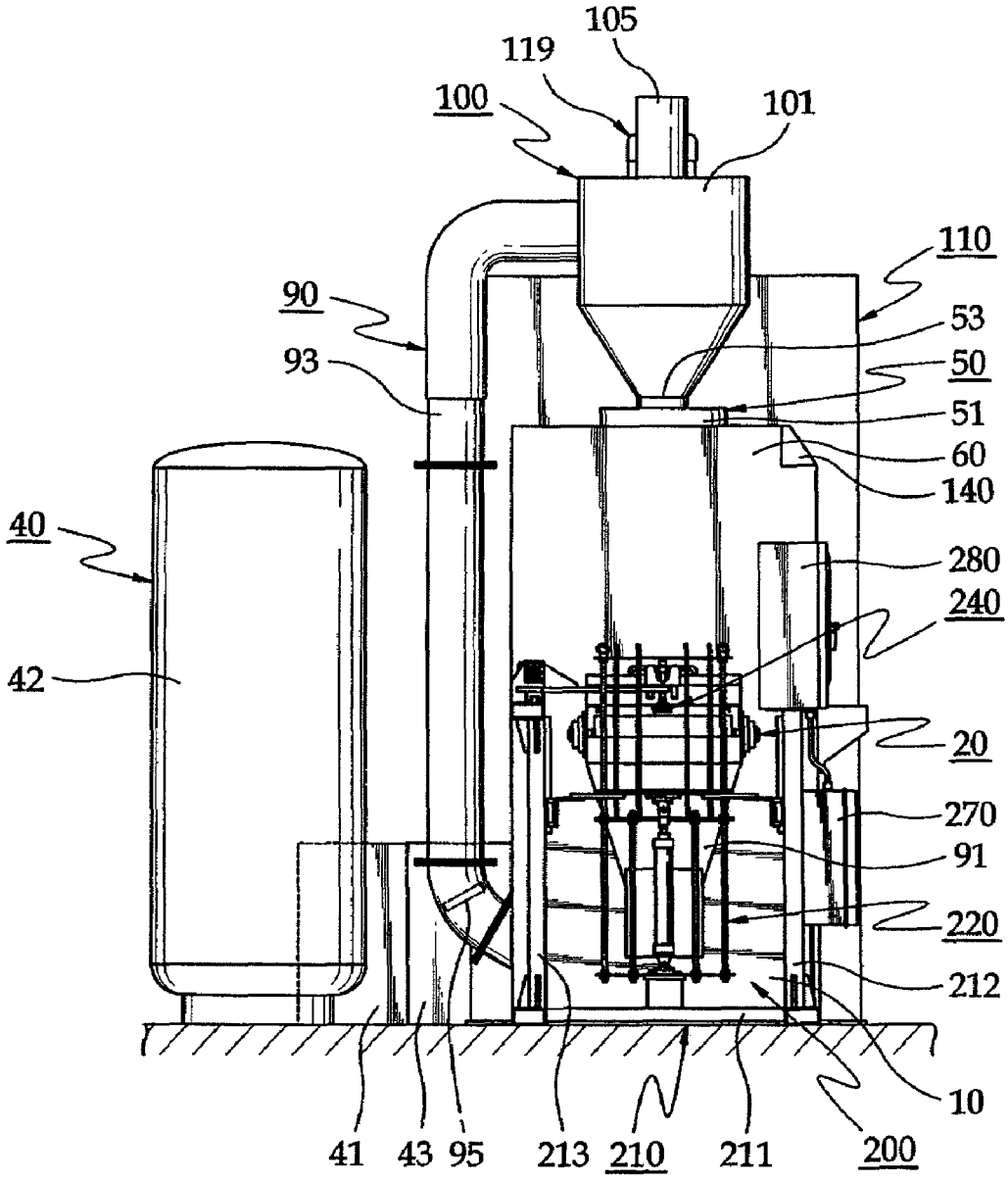
FIG. 2 is a side elevational view of the semiconductor wafer regenerating system shown in FIG. 1.

Referring to FIGS. 1 and 2, a semiconductor wafer regenerating system (referred to as "wafer regenerating system" hereinbelow) according to a preferred embodiment of the present invention includes a frame 10 above which is provided a mesh conveyor 20 for transferring silicon wafer 1. Also, above the frame 10 are provided a blasting booth 60 and a cleaning booth 65 enclosing upper side and the lateral side of mesh conveyor 20 in a line. Inside the blasting booth 60 is provided a grit blaster which blasts grits along with compressed air onto the silicon wafer to remove patterns formed on the silicon wafer. Meanwhile, inside the cleaning booth 65 is provided a cleaning nozzle which blows off impurities remaining on the wafer surface using compressed air.

On the other hand, underneath the mesh conveyor 20 is provided a collecting unit 90 which collects grits bypassing the wafer, grits bounced by the wafer after colliding against the wafer to remove the patterns, scraps of grits (G)enerated by the collision against the wafer, pieces of insulation material and/or metal interconnections separated from the wafer, and shattered powder of wafer and grits. In this specification including the claims, a term "grits (G)" is used to generally refer to originally replenished grits, the grits bypassing the wafer, grits bounced by the wafer after colliding against the wafer to remove the patterns, and scraps of grits (G)enerated by the collision against the wafer. A term "chips (C)" is used to generally refer to pieces of insulation material and/or metal interconnections separated from the wafer. A term "dusts (D)" is used to refer to shattered powder of wafer and grits. In addition, a term "pulverulent bodies (P)" is used to refer the aggregate of the grits (G), chips (C), and dusts (D).

A cyclone separator 100, which is connected to the collecting unit 90, receives the pulverulent bodies (P) from the collecting unit 90 to centrifugally separate the grits (G) and chips (C) from the dusts (D). A dust collector 110, which is connected to the cyclone separator 100, collects the dusts exhausted from the cyclone separator 100.

Figure 3:
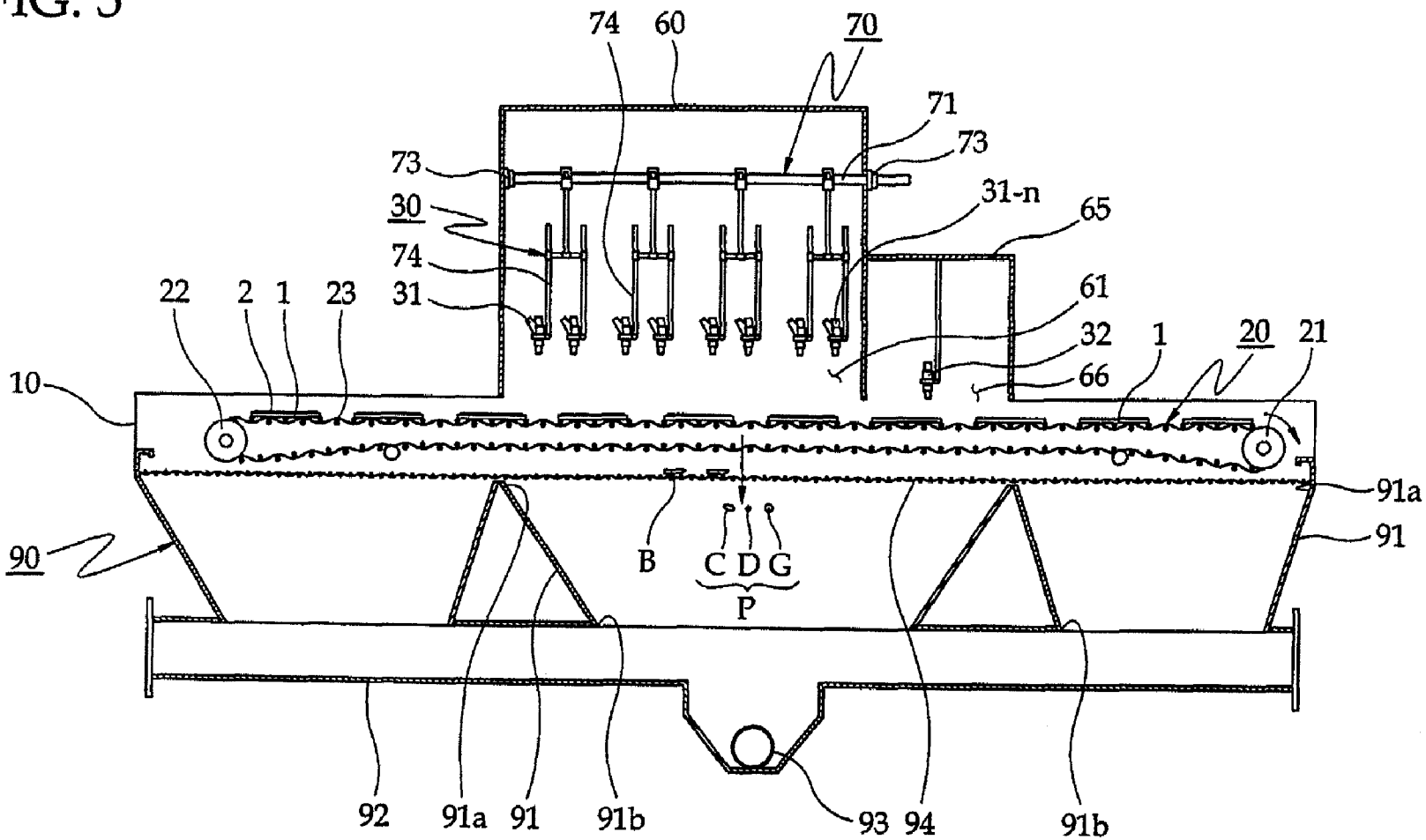
FIG. 3 is a cross-sectional view depicting a mesh conveyor, a grit blaster, a cleaning nozzle and a pulverulent body collecting unit employed in the semiconductor wafer regenerating shown in FIG. 1.

Referring to FIG. 3, the mesh conveyor 20 is comprised of a driving pulley 21, a driven pulley 22, a mesh belt 23, and a motor 24. The driving pulley 21 and the driven pulley 22 are provided in a spaced-apart relationship along a moving direction of the silicon wafer 1. The mesh belt 23 is wound around the driving pulley 21 and the driven pulley 22. The silicon wafers 1 are consecutively placed on the mesh belt 23 in such a manner that the patterns formed on the silicon wafers 1 face an upward direction. The mesh belt 23 is preferably made of a stainless wire and has mesh apertures having a size of, e.g., about 10-20 $mm^2$. The motor (denoted by a reference numeral 24 in FIG. 5) is mounted on one side of the frame 10 and can generate a driving force which is transferred to the driving pulley 21 through a belt transmission mechanism (denoted by a reference numeral 25 in FIG. 5). The motor may be comprised of a geared motor that has an ability to transmit the driving force to the driving pulley 21 at a reduced ratio.

The blasting booth 60 has a first tunnel 61 through which the mesh conveyor 20 moves. Attached to the front side of the blasting booth 60 is a door 62 that can be opened for maintenance of the grit blasting nozzles 31. The door 62 has a window 63 through which an operator can look into the first tunnel 61. Just like the blasting booth 60, the cleaning booth 65 has a second tunnel 66 through which the mesh conveyor 20 passes. The first tunnel 61 of the blasting booth 60 is aligned with and joined to the second tunnel 66 of the cleaning booth 65. Attached to the front side of the cleaning booth 65 is a door 67 that can be opened for maintenance of the cleaning nozzle 32. The door 67 has a window 68 through which an operator can look into the second tunnel 66.

The upstream end of the mesh conveyor 20 is exposed to the outside of the blasting booth 60 to allow the silicon wafer 1 to be loaded into the blasting booth 60. Also, the downstream end of the mesh conveyor 20 is exposed to the outside of the cleaning booth 65 to allow the silicon wafer 1 to be unloaded from the cleaning booth 65. While the cleaning booth 65 is provided separately from the blasting booth 60 in the present embodiment, the cleaning booth 65 may be removed from the system by disposing the cleaning nozzle 32 at the downstream region within the first tunnel 61 of the blasting booth 60 and providing a partition wall into the first tunnel 61 to isolate the grit blaster 30 and the cleaning nozzle 32, alternatively.

The grit blaster 30 includes a plurality of grit blasting nozzles 31, a compressed air supply unit 40 and a grit supply unit 50. The grit blasting nozzles 31 are disposed along a longitudinal direction of the mesh conveyor 20 so that they can blast the compressed air and the grits toward the surface of the silicon wafers 1 placed on and moved by the mesh belt 23 of the mesh conveyor 20.

Figure 6:
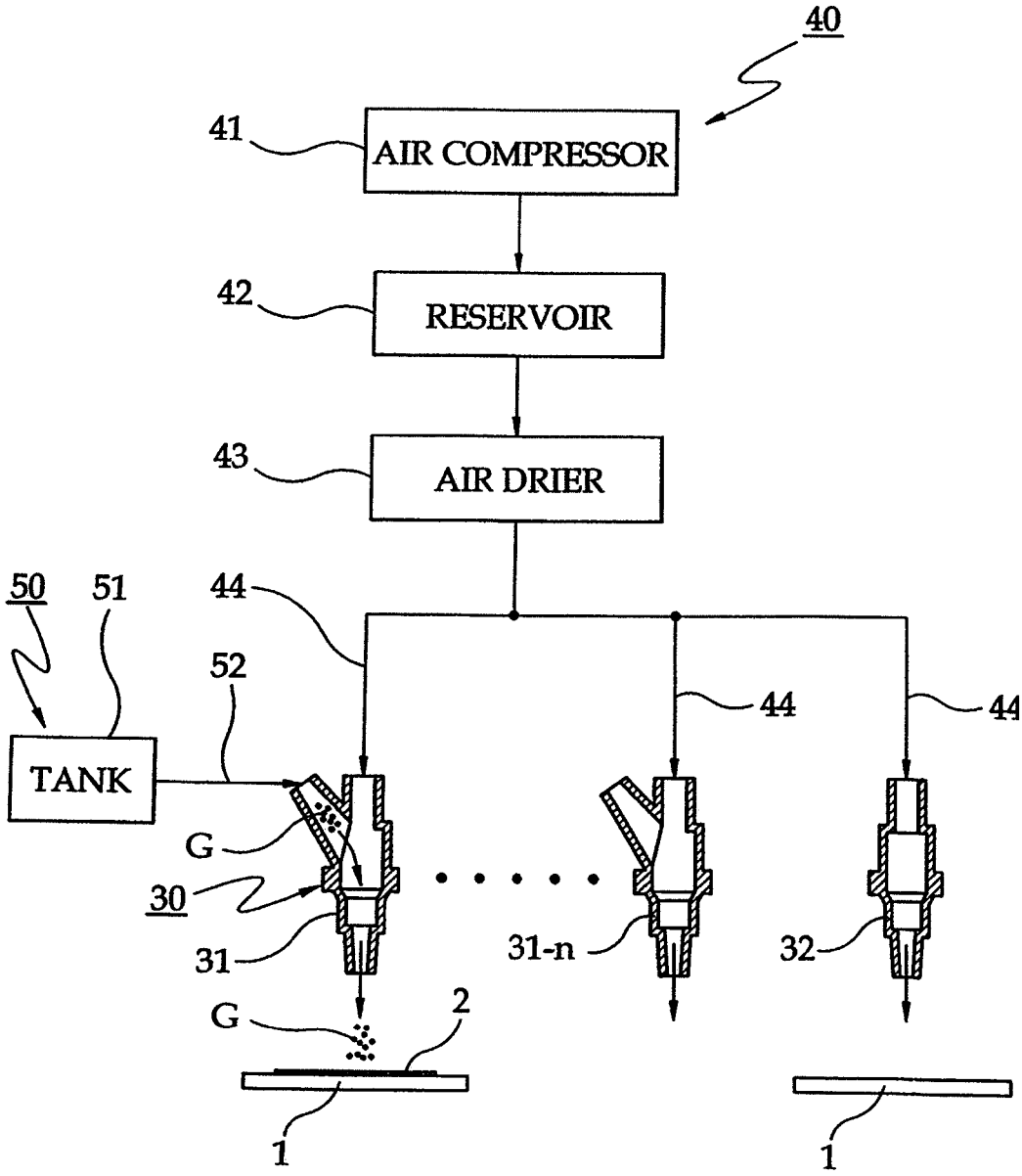
FIG. 6 is a block diagram showing a grit blaster employed in the semiconductor wafer regenerating system shown in FIG. 1.

Referring to FIG. 6, the compressed air supply unit 40 includes an air compressor 41, a reservoir 42, an air drier 43, and a plurality of air pipelines 44. The air compressor 41 is provided in proximity to one side of the frame 10 and remains connected to the reservoir 42 which in turn is in communication with the air drier 43. The compressed air generated by the air compressor 41 is stored in the reservoir 42 from which air is supplied to the air drier 43. The air drier 43 serves to eliminate impurities such as moisture, oil, dusts and the like contained in the compressed air and also plays a role of controlling the flow rate of the compressed air. The air drier 43 may be comprised of an air control unit capable of eliminating the impurities contained in the compressed air and controlling the flow rate of the compressed air. The air drier 43 is connected to the grit blasting nozzles 31 through the air pipelines 44 so that the compressed air supplied from the air drier 43 can be blasted toward the surface of the silicon wafers 1 from the grit blasting nozzles 31.

The cleaning nozzle 32 is connected to the air drier 43 via one of the air pipelines 44. Although the cleaning nozzle 32 is one in number in the illustrated embodiment, the number of the cleaning nozzle 32 may be increased as occasions demand.

Figure 7:
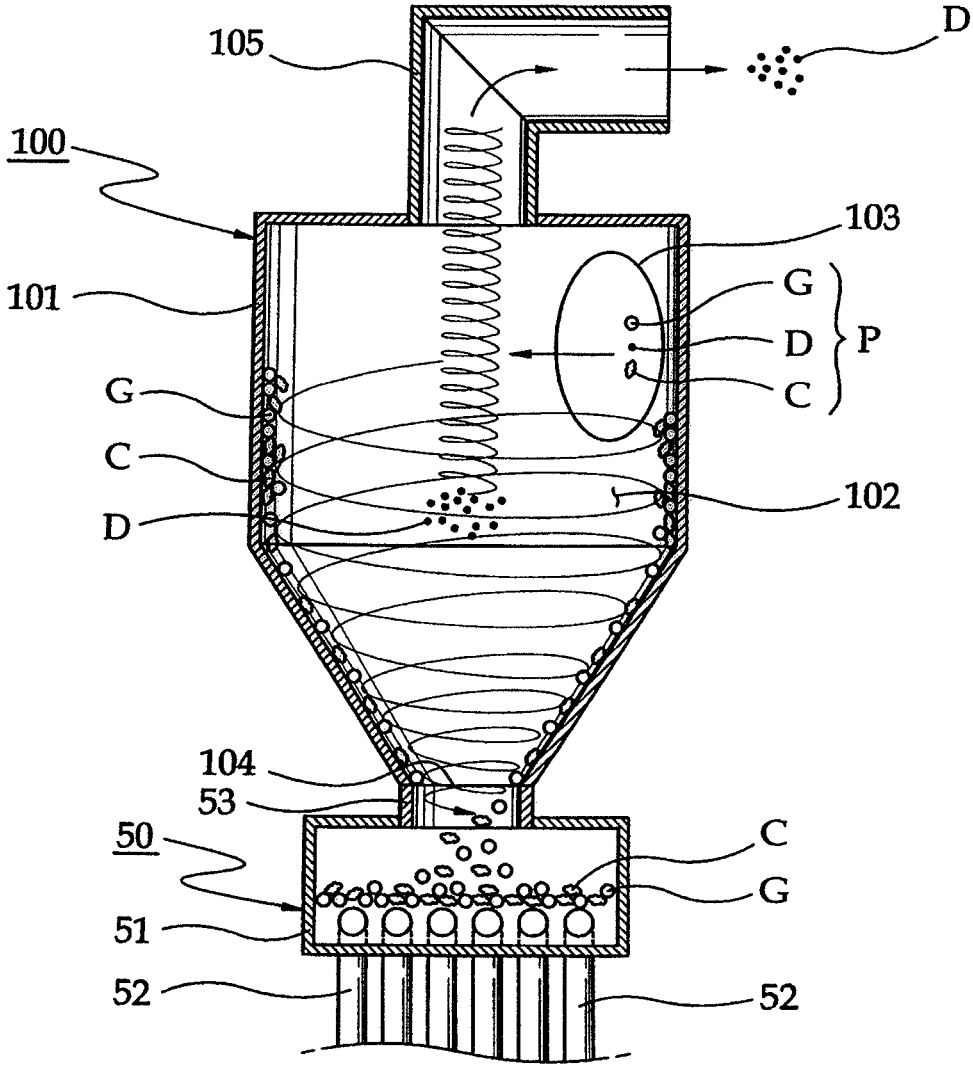
FIG. 7 is a cross-sectional view illustrating a grit supply device and a cyclone separator employed in the semiconductor wafer regenerating system shown in FIG. 1.

Referring to FIG. 7, the grit supply unit 50 includes a tank 51 for storing a large quantity of grits and a plurality of grit pipelines 52 for interconnecting the grit blasting nozzles 31 and the tank 51 to provide passageways through which the grits stored in the tank 51 are supplied to the grit blasting nozzles 31. Examples of the grits available for use include particles of aluminum oxide, silicon carbide and ceramics, glass beads, steel balls, and chip separated from silicon wafers. Among these, the particles of aluminum oxide, silicon carbide and ceramics may have a grain size of, e.g., 10-80 μm.

Figure 4:
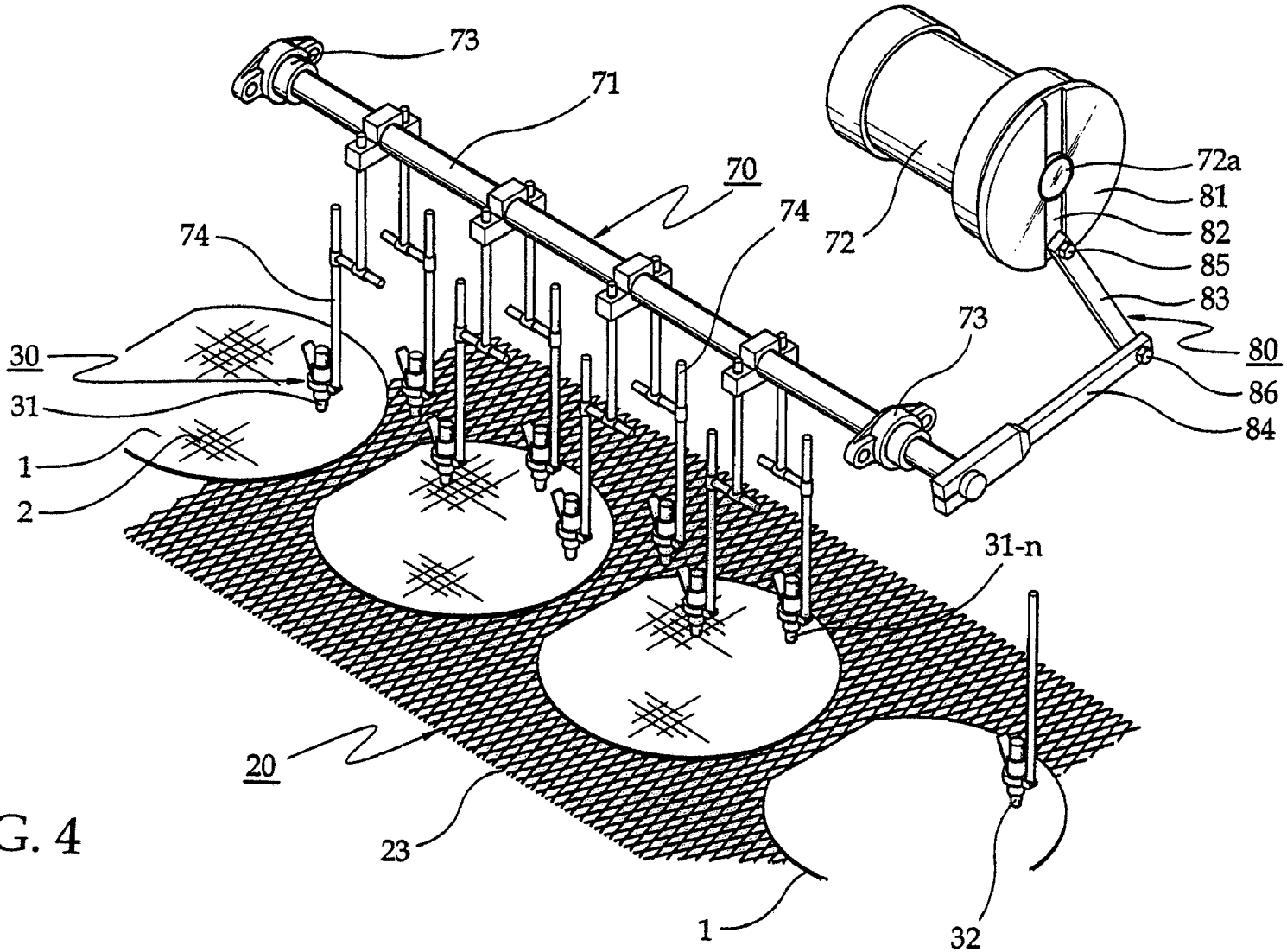
FIG. 4 is a perspective view showing a mesh conveyor, a grit blaster, a cleaning nozzle and a swing arrangement employed in the semiconductor wafer regenerating system shown in FIG. 1.
Figure 5:
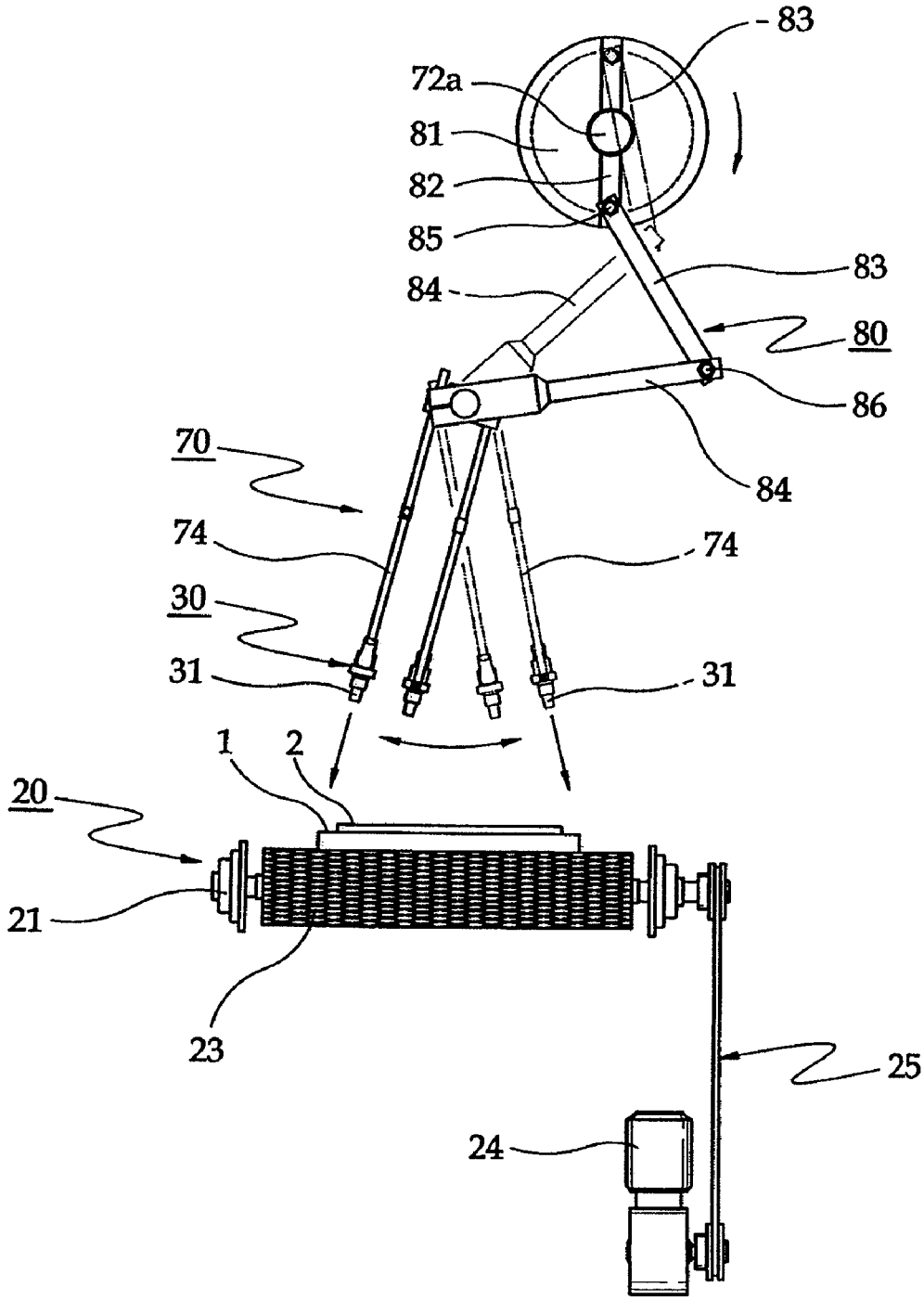
FIG. 5 is a side elevational view illustrating a mesh conveyor, a grit blaster and a swing arrangement employed in the semiconductor wafer regenerating system shown in FIG. 1.

Referring to FIGS. 4 and 5, the silicon wafer regenerating system in accordance with the present invention further includes a swing arrangement 70 for swinging the grit blasting nozzles 31 into a direction perpendicular to the moving direction of the silicon wafers 1. The swing arrangement 70 is comprised of a spindle 71, a swing motor 72 and a linkage 80. The spindle 71 extends in parallel with the moving direction of the silicon wafers 1, the opposite ends of which are rotatably supported by a pair of bearings 73. The bearings 73 are fixedly secured to the opposite sides of the blasting booth 60. One end of the spindle 71 protrudes through the blasting booth 60. A plurality of support bars 74 are attached to the spindle 71 in a spaced-apart relationship along the moving direction of the silicon wafers 1. The grit blasting nozzles 31 are respectively affixed to the lower ends of the support bars 74. The swing motor 72 is mounted on the outside of the blasting booth 60.

The linkage 80 serves to convert and deliver the rotational force of the motor 72 to the spindle 71 in such a manner that the spindle 71 can be caused to swing. The linkage 80 is comprised of a disk 81, a first link 83 and a second link 84. The disk 81 is mounted to a shaft 72*a* of the motor 72 and has a guide groove 82 extending in a radial direction. The first link 83 is provided at one end with a screw 85 which in turn is slidably fitted into the guide groove 81. One end of the second link 84 is joined to the other end of the first link 83 by a pivot pin 86 for rotation about the latter. The other end of the second link 84 is fixedly secured to an extremity of the spindle 71.

The spindle 71 is caused to swing if the driving force of the motor 72 is transmitted to the spindle 71 through the disk 81, the first link 83 and the second link 84. As the spindle 72 is subjected to swinging movement, the grits blasted from the grit blasting nozzles 31 are initially hit on the center and then on the peripheral area of the silicon wafers 1, thus assuring that the entire surface of the silicon wafer 1 is hit by the grits. Although the grit blasting nozzles 31 are arranged in two rows along the moving direction of the silicon wafers 1 in FIGS. 4 and 5, this is for the purpose of illustration and it would be possible to dispose the grit blasting nozzles 31 in a single row if desired. Furthermore, the grit blasting nozzles 31 may be mounted in such a fashion that they can make linear reciprocating movement in a direction across the moving direction of the silicon wafers 1. In the meantime, if an operator loosens the screw 85 of the first link 83 and then displaces the same along the guide groove 82, it becomes possible to place one end of the first link 83 at any position between the center and the peripheral edge of the disk 81. The swinging angle of the spindle 71 becomes greater as one end of the first link 83 is placed farther away from the center, namely, closer to the peripheral edge, of the disk 81.

Referring back to FIG. 3, the collecting unit 90 is comprised of a plurality of hoppers 91, a first pulverulent body pipeline 92 and a second pulverulent body pipeline 93. Each of the hoppers 91 has an inlet opening 91*a* lying adjacent to the underside of the mesh conveyor 20 and an outlet opening 91*b* connected to the first pulverulent body pipeline 92. The first pulverulent body pipeline 92 is connected at its one end to the second pulverulent body pipeline 93 through which the pulverulent bodies (P) are discharged to the outside. Mounted on the top of the hoppers 91 is a first screen filter 94 that can filter out broken fragments of the silicon wafer 1. A second screen filter 95 that can filter out the chips (C) greater in size than the grits (G) is provided at the upstream end portion of the second pulverulent body pipeline 93 in the vicinity of the first pulverulent body pipeline 92.

Referring to FIG. 7, the cyclone separator 100 is provided with an upright housing 101 having a chamber 102. The housing 101 has at its upper side wall an inlet opening 103 connected to the second pulverulent body pipeline 93 and at its bottom end an outlet opening 104 through which the chips (C) and the grits (G) are discharged. Connected to the top center of the housing 101 is an outlet pipe 105 through which the dusts (D) are exhausted from the chamber 102. The outlet opening 104 of the housing 101 is connected to the tank 51 of the grit supply unit 50 through a grit return pipeline 53. Although the housing 101 of the cyclone separator 100 and the tank 51 of the grit supply unit 50 are placed on the top of the blasting booth 60 in FIGS. 1 and 2, they may be detached from the blasting booth 60 and placed at other suitable positions, if desired.

Figure 8:
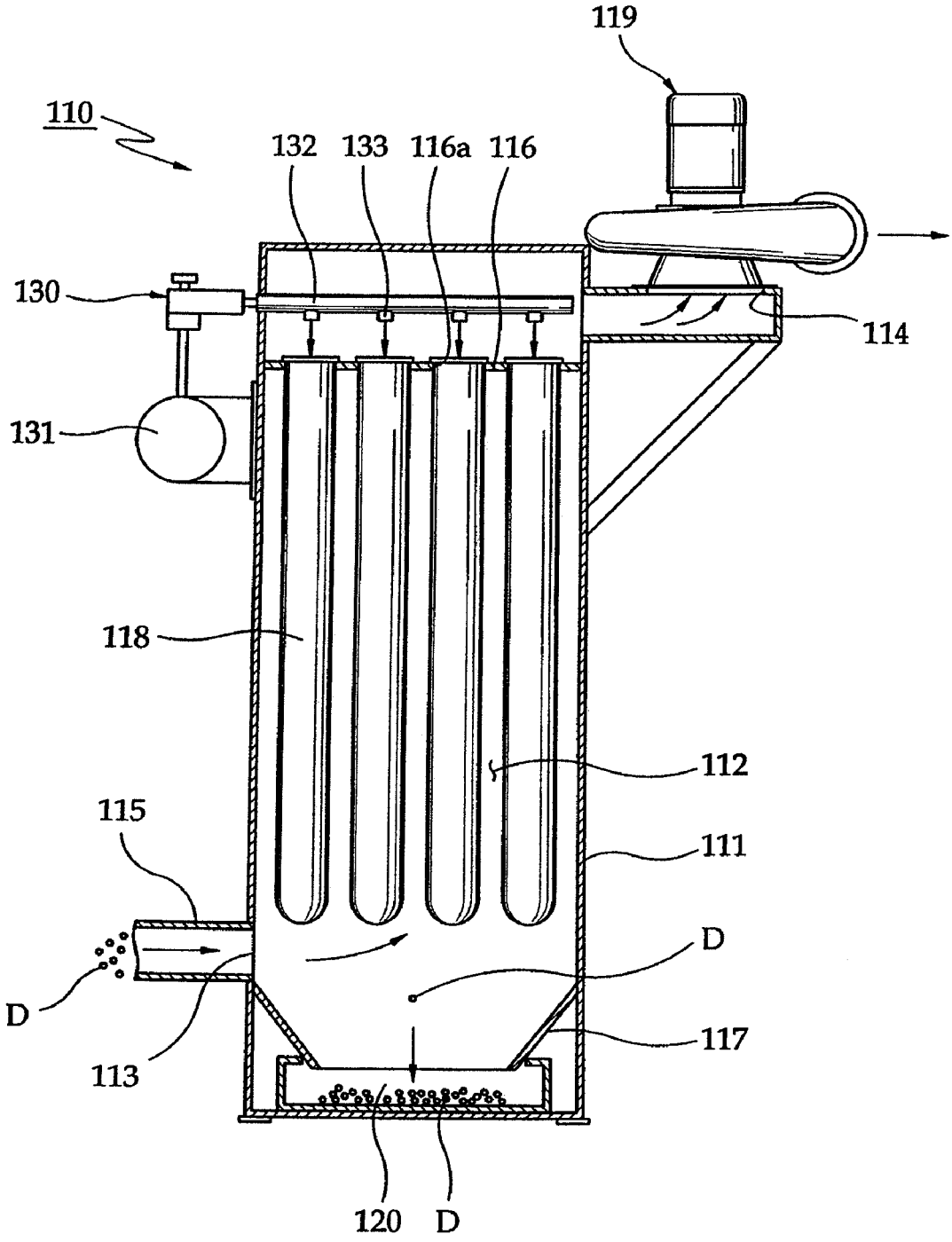
FIG. 8 is a cross-sectional view showing a dust collector employed in the semiconductor wafer regenerating system shown in FIG. 1.

Referring to FIG. 8, the dust collector 110 is provided with an upright housing 111 having a chamber 112. The housing 111 has an inlet port 113 at its lower side wall portion and an outlet port 143 at its upper side wall portion. The inlet port 113 of the housing 111 is connected to the outlet pipe 105 of the cyclone separator 100 through a dust pipeline 115. A partition 116 for dividing the chamber 112 into two compartments is provided at the upper portion of the chamber 112. A plurality of apertures 116*a* that allow the air to pass are formed through the thickness of the partition 116. A plurality of filters 118 for filtering the dusts are fitted to the apertures 116*a* of the partition 116. Disposed at the lower part of the chamber 112 is a hopper 117 that helps the dusts to move downwards.

An air blower 119 is attached to the outlet port 114 of the housing 111, which blower 119 serves to draw and discharge the air filtered by the filters 118. The air blower 119 may be comprised of a typical vacuum pump. Disposed at the bottom of the housing 111 is a dust box 120 that collects the dusts (D)ropped through the hopper 117. A first door 121 is attached to the upper side wall of the housing 111, which door 121 can be opened for maintenance of the filters 118. A second door 122 is attached to the lower side wall of the housing 111, which door 122 can be opened when a need exists to draw out the dust box 120.

Although the dust collector 110 shown and described herein is an ascending flow type in which the air flows upwards from the inlet port 113 toward the outlet port 114, it would be possible to change the dust collector 110 to a descending flow type wherein an inlet port is interchanged with an outlet port. Moreover, although the dust collector 110 shown and described herein is a dry type in which the dusts are filtered by the filters 118, other types of dust collectors such as a wet type dust collector, an electric dust collector or the like may be used in place thereof if such need arises.

The dust collector 110 is provided with an air blaster 130 for injecting a compressed air toward the filters 118 to remove the dusts adhered thereto. The air blaster 130 is comprised of an air compressor 131 for generating the compressed air and a plurality of nozzles 133 connected to the air compressor 131 through an air pipeline 132 for injecting the compressed air toward the filters 118. Alternatively, the nozzles 133 may be connected to the air drier 43 of the compressed air supply unit 40 through the air pipeline 132, in which case the air compressor 131 can be eliminated. The air blaster 130 may be replaced with a well-known vibration generator of the type applying vibration to a filter to remove dusts stuck thereto.

Figure 9:
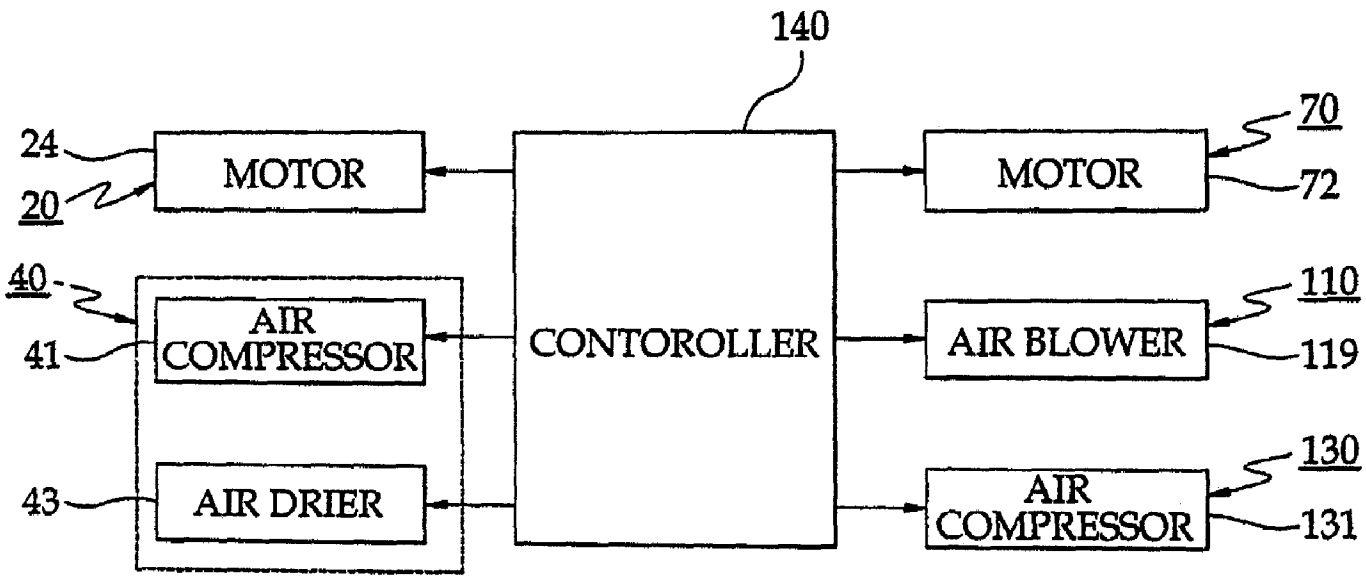
FIG. 9 is a block diagram showing a controller employed in the semiconductor wafer regenerating system shown in FIG. 1.
Figure 10:
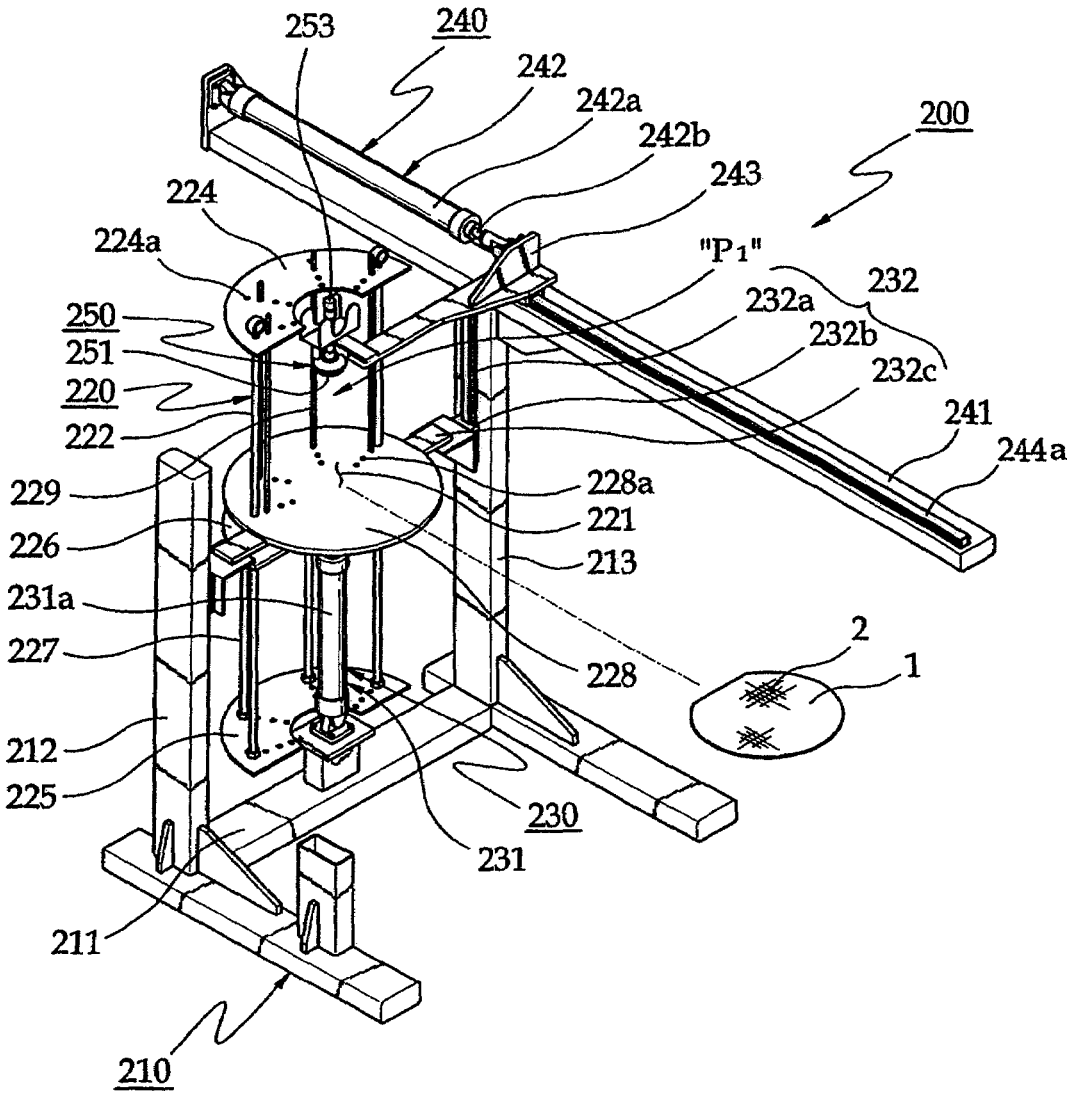
FIG. 10 is a perspective view showing a destacker employed in a semiconductor wafer regenerating system of the present invention.

Referring to FIG. 9, a controller 140 is provided to control the motor 24 of the mesh conveyor 20, the air compressor 41 and the air drier 43 of the compressed air supply unit 40, the swing motor 72 of the swing arrangement 70, the air blower 119 of the dust collector 110, and the air compressor 131 of the air blaster 130. The controller 140 is preferably mounted to a side wall of the blasting booth 60.

In the silicon wafer regenerating system in accordance with the present invention, it is preferable that the silicon wafers 1 are automatically placed on the mesh belt 23 one after another. FIGS. 10 through 14 shows an embodiment of a distacker 200 being provided at the upstream side of the mesh conveyor 20 for consecutively loading the silicon wafers 1 one after another on the mesh conveyor 20. The destacker 200 includes a frame 210, a stacker 220, a lifting arrangement 230, a feeder 240, a vacuum suction unit 250, an air blaster 260, a compressed air supply unit 270 and a controller 280. The frame 210 includes a base 211 and first and second side frames 212 and 213 provided at the opposite sides of the base 211.

As shown in FIGS. 10 through 13, the stacker 220 is mounted on the center of the base 211 for stacking a large number of silicon wafers 1 one atop above. The stacker 220 includes a plurality of support bars 222 extending vertically to define a stacking space 221 within which the silicon wafers 1 can be accommodated in multiple layers. As is apparent in FIG. 13, the support bars 222 are arranged along an imaginary circle at the rear half part of the stacking space 221 with respect to a horizontal center line 223 so that the silicon wafers 1 can be loaded from the front side of the stacking space 221. A top fixture plate 224, a bottom fixture plate 225 and an intermediate fixture plate 226 are secured to the top, bottom and intermediate portions of the support bars 222. A plurality of reinforcing bars 227 for reinforcing the mechanical strength of the stacker 220 are affixed at their opposite ends to the bottom fixture plate 225 and the intermediate fixture plate 226.

Just above the intermediate fixture plate 226, a table 228 for carrying the silicon wafers 1 is fitted to the support bars 222 for sliding movement along the same. The top fixture plate 224 and the table 228 are respectively provided with a plurality of radially arranged positioning holes 224*a* and 228*a* through which a plurality of positioning bars 229 penetrate in a matching relationship with the diameters of the silicon wafers 1 to make contact with the periphery of the latter. The positioning bars 229 are capable of supporting the silicon wafers 1 of up to 300 mm in diameter. The radial positions of the positioning bars 229 can be changed so as to reliably support peripheral edges of the silicon wafers 1 of, e.g., 100 mm, 125 mm, 150 mm and 200 mm in diameter.

The lifting arrangement 230 serves to lift up into a standby position P1 the uppermost silicon wafer 1-1 among the silicon wafers 1 that are stacked within the stacking space 221 of the stacker 220. The lifting arrangement 230 is comprised of a first air cylinder 231 and a first linear motion guide 233. The first air cylinder 231 includes a cylinder housing 231*a* placed upright at the center of the stacker 220. The bottom end of the cylinder housing 231*a* is pivotally joined to the top surface of the base 211. The first air cylinder 231 further includes a cylinder rod 231*b* whose top end is pivotally attached to the underside of the table 228. The first linear motion guide 233 helps the table 228 to make a linear reciprocating movement. The first linear motion guide 233 is comprised of a pair of vertically extending guide rails 233*a* respectively mounted to the inner surfaces of the first and second side frames 212 and 213, a pair of sliders 233*b* mating with the corresponding guide rails 233*a* for sliding movement therealong, and a pair of joints 233*c* interconnecting the respective sliders 233*b* and the table 228.

Alternatively, the lifting arrangement 230 may be comprised of a servo motor for generating a driving force, a lead screw operatively connected to the servo motor for rotation with the servo motor, a ball bush threadedly engaged with the lead screw and fixedly secured to the table 228 for movement as a unit along the ball bush, and a linear motion guide that helps the table 228 to make a linear reciprocating movement in a vertical direction. Furthermore, the first linear motion guide 233 illustrated and describe herein may be comprised of a pair of vertically extending parallel guide bars mounted to the frame 210 and a pair of guide bushes combined with the guide bars for sliding movement and fixedly secured to the table 228.

The feeder 240 serves to unload the uppermost silicon wafer 1-1 among the silicon wafers 1 that are stacked within the stacking space 221 of the stacker 220, and then to load the unloaded silicon wafer 1-1 onto the upstream side of the mesh conveyor 20. The feeder 240 includes an arm 241, a second air cylinder 242, a carriage 243 and a second linear motion guide 244.

The arm 241 is mounted to one of the first and second side frames 212 and 213, namely, the second side frame 213 in the illustrated embodiment, to extend in a horizontal direction. The second air cylinder 242 is provided with a cylinder housing 242*a* lying above the arm 241 in a parallel relationship with respect thereto, the rear end of the cylinder housing 242*a* attached to the arm 241 for pivotal movement. The second air cylinder 242 is further provided with a cylinder rod 242*b*, the distal end of which is pivotally attached to the carriage 243. The second linear motion guide 244 is comprised of a guide rail 244*a* mounted to the top surface of the arm 241 and a slider 244*b* mating with the guide rail 244*a* for sliding movement therealong and attached to the carriage 243. Alternatively, the second air cylinder 242 of the feeder 240 may be comprised of a servo motor capable of causing the carriage 243 to reciprocate along the arm 241, a lead screw and a ball bush threadedly combined with the lead screw.

Figure 11:
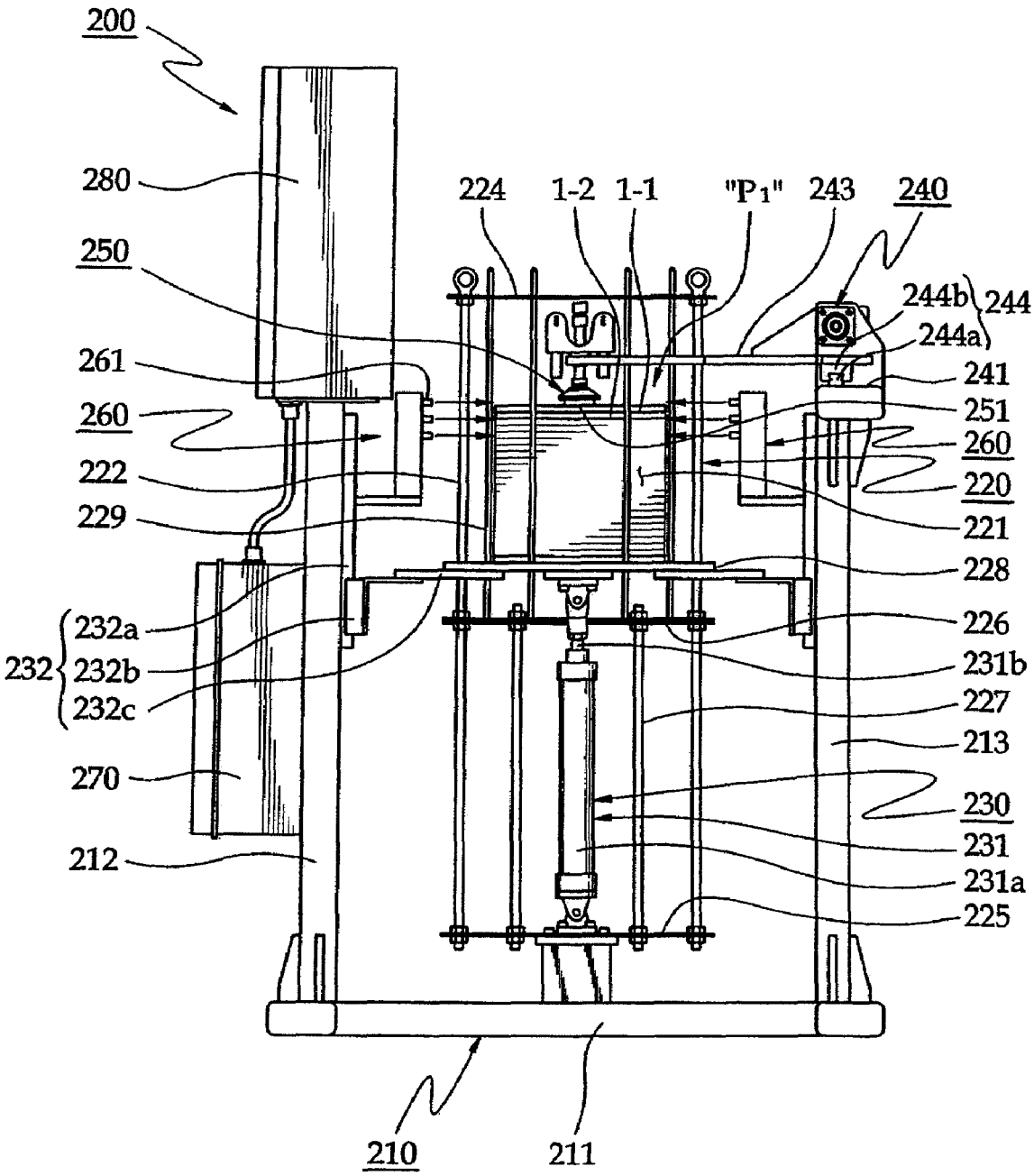
FIG. 11 is a front elevational view showing the destacker shown in FIG. 10.
Figure 12:
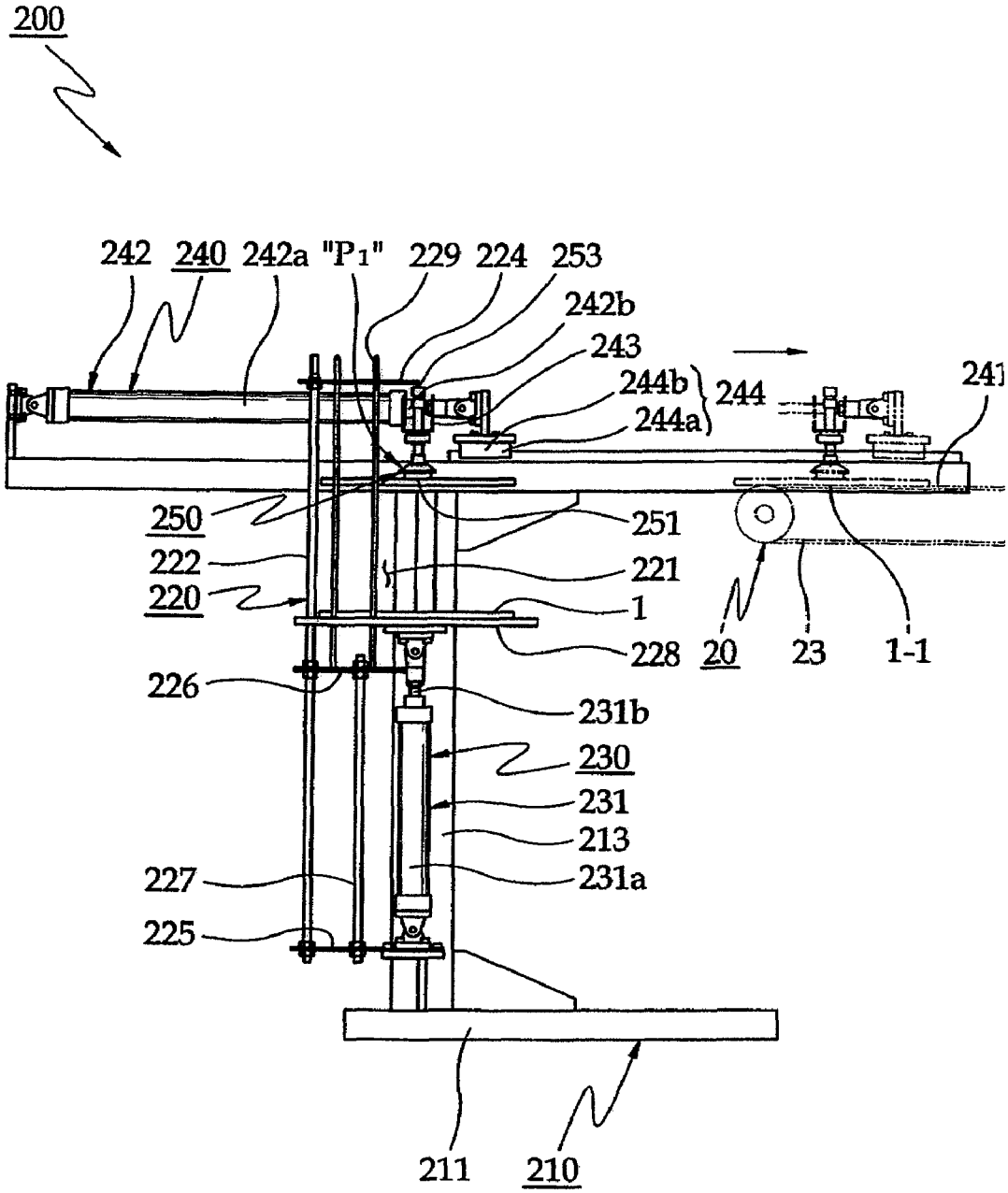
FIG. 12 is a side elevational view showing the destacker shown in FIG. 10.
Figure 13:
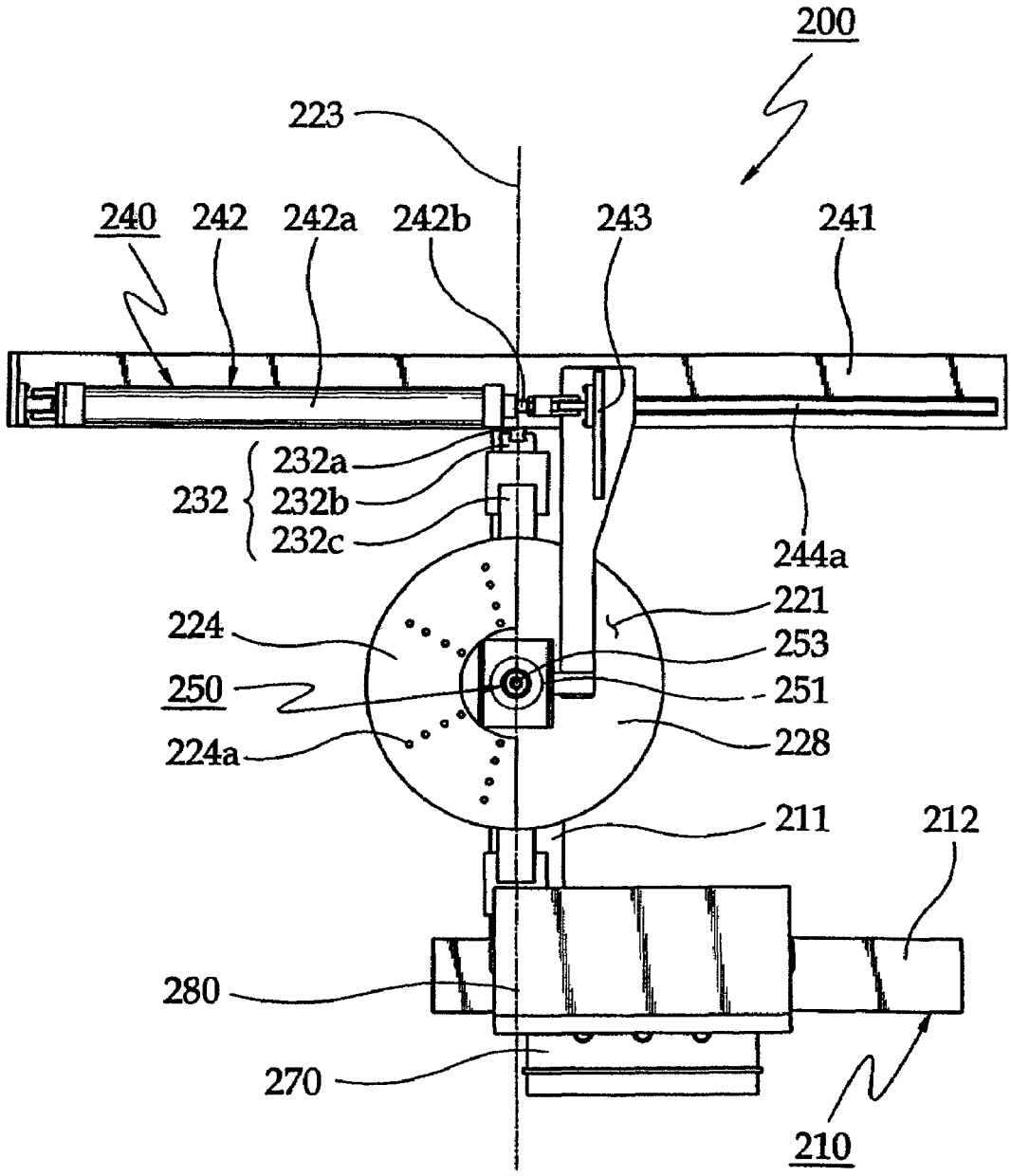
FIG. 13 is a top view showing the destacker shown in FIG. 10.

As shown in FIGS. 11 and 12, the vacuum suction unit 250 has a vacuum pad 251 attached to the underside of the carriage 243 and connected to a vacuum pump 252 for generating a suction force through an air pipeline 253. As the first air cylinder 231 of the lifting arrangement 230 is operated to thereby extend the cylinder rod 231*b*, the uppermost silicon wafer 1-1 comes closer to the vacuum pad 251 at the standby position. Under this condition, if the suction pump 252 creates a suction force, the uppermost silicon wafer 1-1 is sucked up into contact with the vacuum pad 251.

As illustrated in FIG. 11, the air blaster 260 serves to inject a compressed air such that the uppermost silicon wafer 1-1 can be separated from the next silicon wafer 1-2 among the silicon wafers 1 stacked within the stacking space 221 of the stacker 220. The air blaster 260 includes a plurality of nozzles 261 arranged in a vertical direction along one of the first and second side frames 212 and 213, namely, the first side frame 212 in the illustrated embodiment.

Figure 14:
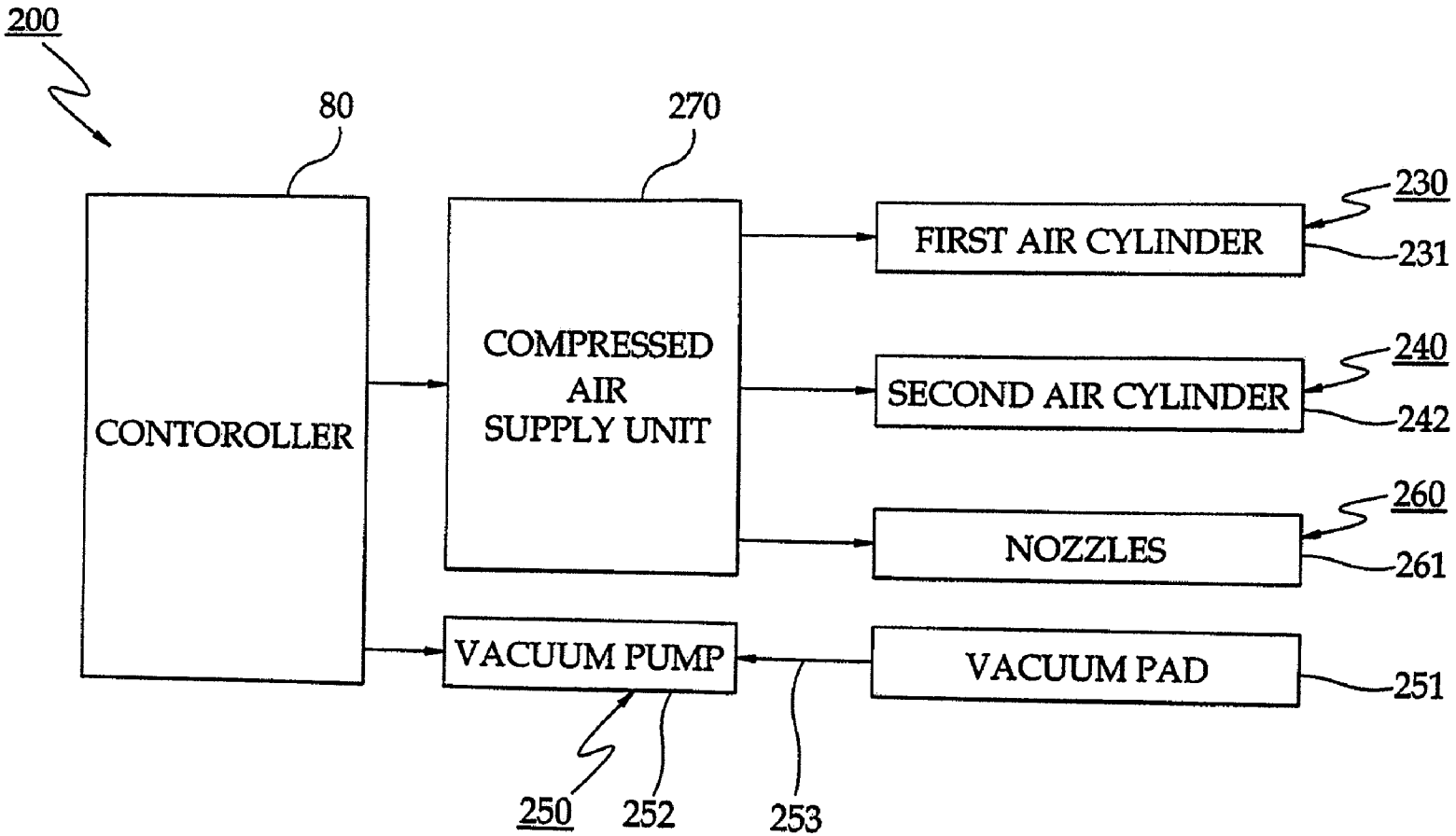
FIG. 14 is a block diagram illustrating a controller for use in the destacker shown in FIG. 10.

Referring to FIG. 14, the compressed air supply unit 270 is mounted on the first side frame 212 to supply a compressed air to the second air cylinder 242 and the nozzles 261 of the air blaster 260. Although not shown in the drawings, the compressed air supply unit 270 is comprised of an air compressor, an air controller and air pipelines. In place of the compressed air supply unit 270, it would be possible for the destacker 200 to use the compressed air supply unit 40 of the grit blaster 30. In this case, the air drier 43 of the compressed air supply unit 40 should be connected to the first air cylinder 231, the second air cylinder 242 and the nozzles 261 of the destacker 200. The controller 280 is mounted on the top of the first side frame 212 and controls operation of the vacuum pump 252 and the compressed air supply unit 270.

Figure 15:
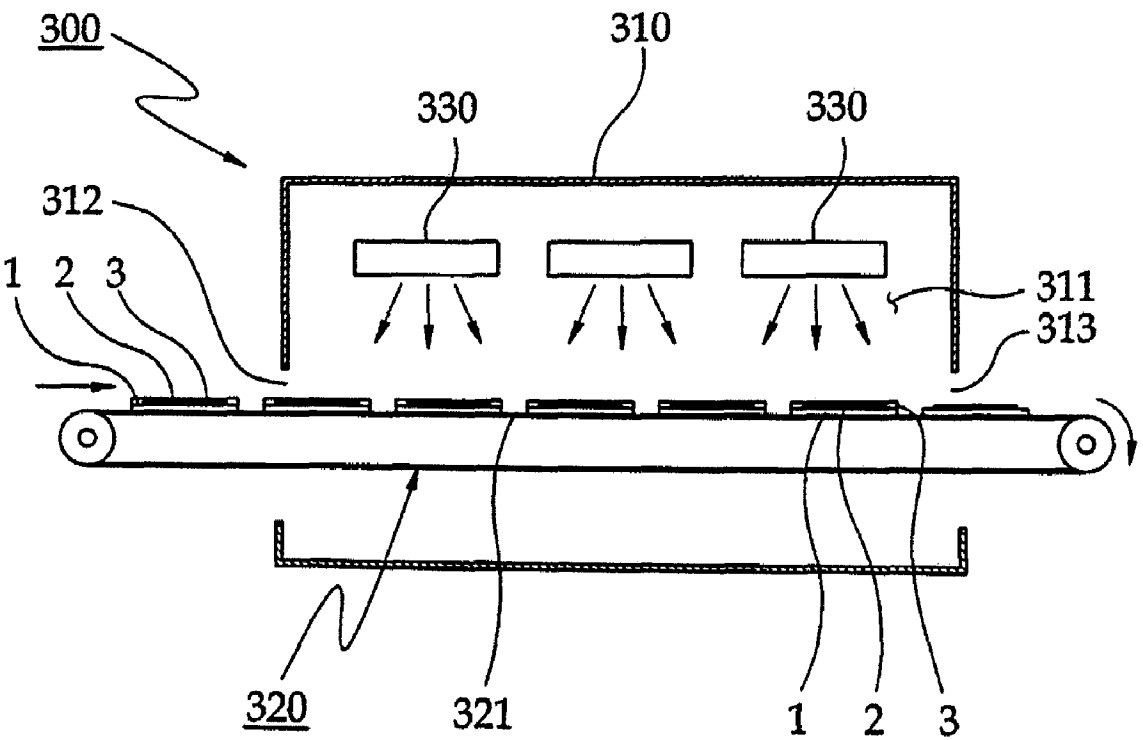
FIG. 15 is a cross-sectional view illustrating an embodiment of a baking device employed in the semiconductor wafer regenerating system of the present invention.

The silicon wafer regenerating system of the present invention may further include a baking unit for removing moisture and a protective film coated on the silicon wafers. FIG. 15 illustrates an embodiment of such a baking unit, which removes moisture and a protective film 3 from the surface of the silicon wafer 1. The baking unit 300 shown in the drawing includes an oven 310, a conveyor 320 and a heater 330. The oven 310 has a drying chamber 311 and is provided with an inlet opening 312 and an outlet opening 313 formed at the opposite sides of the oven 310. The conveyor 320 is provided in such a manner that the upstream and downstream extensions thereof are exposed from the oven 310 to the outside. The heater 330 is disposed at the upper part of the drying chamber 311 to heat the silicon wafers 1 moving with the belt 321 of the conveyor 320. Alternatively, the heater 330 may be disposed under the belt 321 so that it can heat the silicon wafers 1 in a conduction or convection method.

Further, the baking unit 300 may be disposed at the upstream side of the mesh conveyor 20 or the destacker 200 or may be independently installed with respect to the mesh conveyor 20 or the destacker 200. In addition, the conveyor 320 of the baking unit 300 may be disposed in an end-to-end relationship with the mesh conveyor 20. The oven 310 of the baking unit 300 may be of a batch type, in which case the conveyor 320 can be eliminated in its entirety.

Now, mainly with reference to FIG. 16, description will be given to a silicon wafer regenerating method for removing patterns on the silicon wafers using the system described above.

Figure 16:
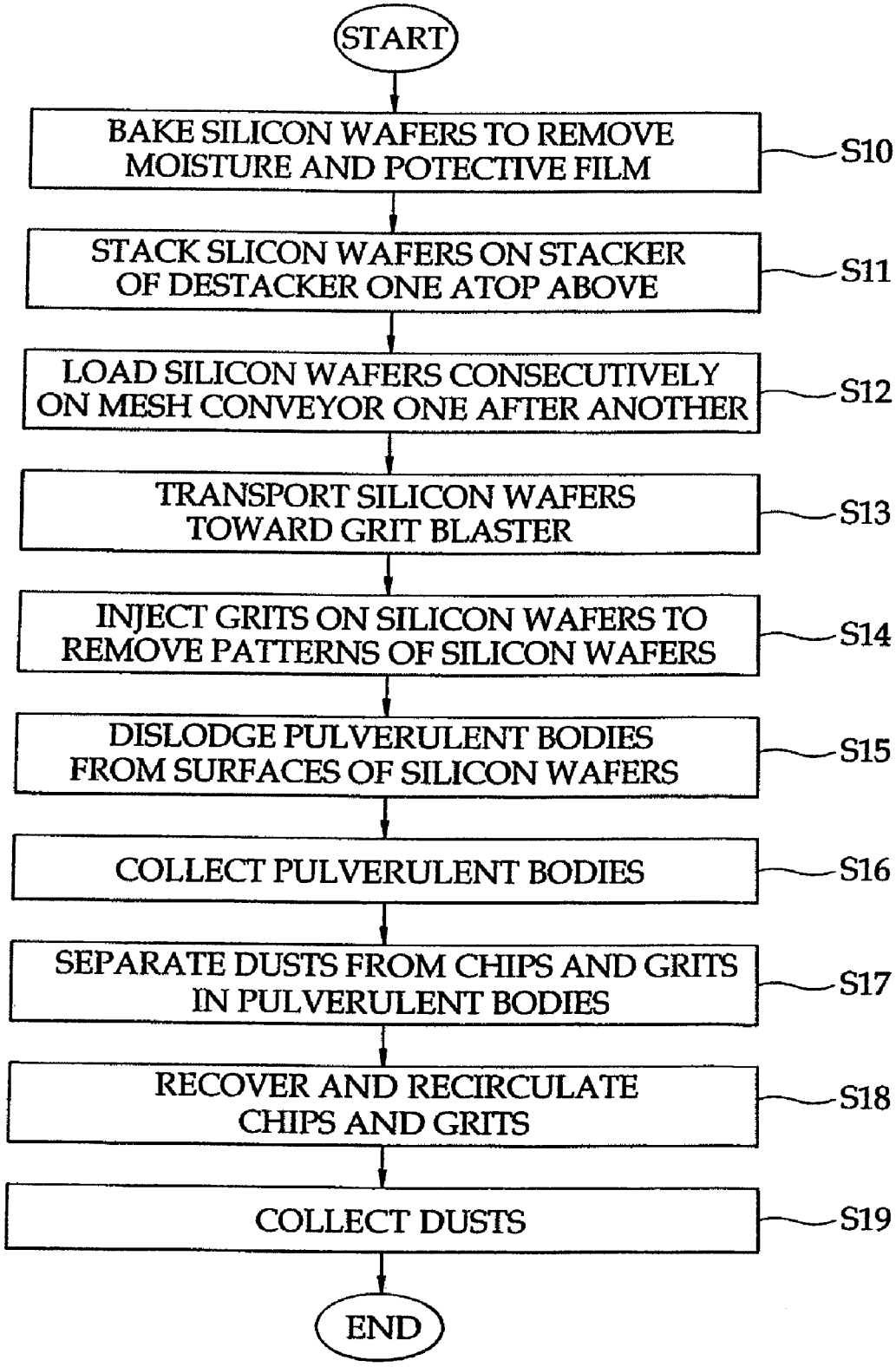
FIG. 16 is a flowchart for explaining a silicon wafer regenerating method in accordance with the present invention.

Referring collectively to FIGS. 15 and 16, the silicon wafers 1 may be stained with moisture in the event that the moisture such as chemicals or water are left on the silicon wafers 1 discharged from a semiconductor manufacturing process. In such a case, the efficiency with which the patterns are removed from the silicon wafers 1 may be reduced due to the fact that the grits (G) blasted by the grit blasting nozzles 31 are adhered to the surface of the silicon wafers 1 and/or the fact that the silicon wafers 1 has a shock-absorbing property against the striking force of the grits (G). Moreover, the protective film 3 covered over the patterns 2 of the silicon wafers 1 has a shock-absorbing property against the striking force of the grits (G).

In view of this, the baking unit 300 is first operated to get rid of the moisture and the protective film 3 from the silicon wafers 1 (S10). For this purpose, the silicon wafers 1 are loaded onto the belt 321 of the conveyor 320, at which time the silicon wafers 1 can be placed on the belt 321 of the conveyor 320 in multiple layers. The conveyor 320 is then operated to feed the silicon wafers 1 into the drying chamber 311 through the inlet opening 312 of the oven 310, and the heater 330 is energized to heat the silicon wafers 1 and thus evaporate the moisture left on the silicon wafers 1. The protective film 3 of the silicon wafers 1 can be removed by, for example, baking the silicon wafers 1 for about 20-30 minutes at a temperature of about 700-800° C. The silicon wafers 1 from which the moisture and the protective film have been removed are discharged from the drying chamber 311 through the outlet opening 313 of the oven 310 by the operation of the conveyor 320. The grit blasting efficiency can be enhanced by removing the moisture and the protective film from the silicon wafers 1 through the baking process and thus making the silicon wafers 1 dry in this manner.

Referring to FIGS. 1, 2 and 10 through 13, the silicon wafers 1 are stacked one atop above within the stacking space 221 of the stacker 200 such that the patterns 2 of the silicon wafers 1 can face in an upward direction (S11). In conformity with the size of the silicon wafers 1, the positioning bars 229 are inserted through the positioning holes 224*a* and 228*a* of the top fixture plate 224 and the table 228 prior to stacking the silicon wafers 1. This ensures that the silicon wafers 1 make contact with at their peripheral edges, and are aligned inside, the positioning bars 229. Silicon wafers of 30 mm in diameter may be aligned in place by use of the support bars 222, while removing the positioning bars 229.

Next, the destacker 200 is operated to consecutively load the silicon wafers 1 one after another onto the upstream extension of the mesh belt 23 of the mesh conveyor 20 (S12). If the first air cylinder 231 of the lifting arrangement 230 is actuated to extend the cylinder rod 231*b*, the silicon wafers 1 are lifted up together with the table 228. The rising movement of the table 228 is linearly guided by means of the slider 233*b* that makes sliding movement along the guide rails 233*a* of the first linear motion guide 233. As the table 228 is lifted up in this manner, the uppermost silicon wafer 1-1 reaches the standby position P1 and lies in proximity with the vacuum pad 251 of the vacuum suction unit 250. The vacuum pump 262 is actuated to generate a suction force by which the uppermost silicon wafer 1-1 is sucked up to the vacuum pad 251. The uppermost silicon wafer 1-1 is separated from the next silicon wafer 1-2 by the compressed air injected from the nozzles 261 of the air blaster 260, as illustrated in FIG. 11.

Referring to FIGS. 3, 4 and 12, the second air cylinder 242 of the feeder 240 is operated to extend the cylinder rod 242*b* after the uppermost silicon wafer 1-1 has been sucked up by the vacuum pad 251 of the vacuum suction unit 250. In response, the carriage 243 and the vacuum pad 251 are moved together toward the frontal end of the arm 241. If the uppermost silicon wafer 1-1 carried by the vacuum pad 251 of the vacuum suction unit 250 arrives at above the mesh belt 23 of the mesh conveyor 20, the vacuum pump 252 ceases to operate and generates no suction force. This allows the uppermost silicon wafer 1-1 to be detached from the vacuum pad 251 and then transferred to the mesh belt 23. If the motor 24 of the mesh conveyor 20 begins to rotate under this state, the driving force of the motor 24 is transmitted to the driving pulley 21 through the belt transmission mechanism 25, in response to which the mesh belt 23 wound around the driving pulley 21 and the driven pulley 22 begins to travel. As the mesh belt 23 travels, the uppermost silicon wafer 1-1 is transported from the upstream side to the downstream side.

In the meantime, after the uppermost silicon wafer 1-1 has been loaded onto the mesh conveyor 20 by the action of the feeder 240, the cylinder rod 242*b* of the second air cylinder 242 is retracted to thereby return the carriage 243 and the vacuum pad 251 to their original position. As the vacuum pad 251 is returned back to the original position, the first air cylinder 231 is actuated again and performs the same operation as did with respect to the uppermost silicon wafer 1-1. This allows the next silicon wafer 1-2 to be moved upwards and sucked up by the vacuum pad 251. The next silicon wafer 1-2 is loaded onto the upstream side of the mesh conveyor 20 by the action of the feeder 240. Alternatively, the silicon wafers 1 may be manually loaded onto the mesh conveyor 20 by the operator.

Referring to FIGS. 3, 5 and 6, the mesh conveyor 20 continues to operate and transports the silicon wafers 1 along the first tunnel 61 of the blasting booth 60 (S13). The grits (G) are blasted toward the surfaces of the moving silicon wafers 1 to remove the defective patterns 2 of the silicon wafers 1 (S14). In this process, the air compressor 41 of the compressed air supply unit 40 is operated to supply the compressed air to the grit blasting nozzles 31 which in turn blast the compressed air and the grits (G) toward the surfaces of the silicon wafers 1 transported by the mesh belt 23. The grits (G) thus blasted strike and remove the patterns 2 of the silicon wafers 1.

The pulverulent bodies (P) are dislodged from the surfaces of the silicon wafers 1 whose patterns 2 have been removed (S15). In this process, the silicon wafers 1 whose patterns 2 have been removed in the first tunnel 61 of the blasting booth 50 is transferred to the second tunnel 61 of the cleaning booth 65 by the operation of the mesh conveyor 20. A compressed air is injected from the cleaning nozzle 32 that remains connected to one of the air pipelines 44 of the compressed air supply unit 40. The pulverulent bodies (P) are dislodged from the surfaces of the silicon wafers 1 by the compressed air. The silicon wafers 1 from which the pulverulent bodies (P) have been dislodged are moved past the second tunnel 61 of the cleaning booth 65 toward the downstream side of the mesh conveyor 20 at which the silicon wafers 1 are unloaded from the mesh conveyor 20. The silicon wafers 1 whose defective patterns 2 were removed in this manner may be used as a silicon wafer for, e.g., solar cells.

As illustrated in FIG. 3, the pulverulent bodies (P) inclusive of the wafer chips (C), the dusts (D) and the grits (G) dropped from the mesh belt 23 of the mesh conveyor 20 are collected in the first pulverulent body pipeline 92 via the hoppers 91 (S16). The silicon wafers 1 may be fractured into fragments B in the process of removing the patterns 2 by the grit blasting operation. The fragments B of the silicon wafers 1 cannot pass the mesh belt 23 for their most parts. Some fragments B having a small size are dropped through the mesh belt 23 and filtered out by means of the first screen filter 94. This prevents the first pulverulent body pipeline 92 from being clogged with the fragments B.

Referring to FIGS. 1 and 7, the pulverulent bodies (P) collected in the first pulverulent body pipeline 92 of the collecting unit 90 is supplied to the cyclone separator 100 where the dusts (D) are separated from the chips D and the grits (G) (S17). More specifically, the air blower 119 of the dust collector 110 is operated to generate a vacuum pressure by which the pulverulent bodies (P) collected in the first pulverulent body pipeline 92 are supplied to the cyclone separator 100 through the second pulverulent body pipeline 93. The second screen filter 95 provided between the first pulverulent body pipeline 92 and the second pulverulent body pipeline 93 filters out the chips (C) whose particle size is greater than 80 μm, for instance. Filtering out the chips (C) of a great size at the upstream side of the second pulverulent body pipeline 93 ensures that the second pulverulent body pipeline 93, the grit blasting nozzles 31 and the grit pipeline 52 are prevented from any unwanted clogging. The pulverulent bodies (P) introduced into the chamber 102 through the inlet opening 103 of the housing 101 are sorted under the action of a swirling air stream. The chips (C) and the grits (G) having a particle size of, e.g., no smaller than 10 μm, impact on the internal surface of the housing 101 and then discharged through the outlet opening 104, whereas the dusts (D) having a particle size of smaller than 10 μm are borne by the swirling air stream and then exhausted through the outlet pipe 105.

The chips (C) and the grits (G) discharged from the chamber 102 of the cyclone separator 100 are recovered into the tank 51 of the grit supply unit 50 (S18). Specifically, the air compressor 41 is operated to supply a compressed air to the grit blasting nozzles 31 through the air pipelines 44. As the compressed air is injected from the grit blasting nozzles 31, a vacuum pressure is developed in the grit pipelines 52 connected to the grit blasting nozzles 31. Under the action of the vacuum pressure, the chips (C) and the grits (G) discharged from the chamber 102 of the cyclone separator 100 are recovered into the tank 51 through the grit return pipeline 53. The chips (C) and the grits (G) thus recovered are recirculated through the grit blasting nozzles 31 of the grit blaster 30.

Referring to FIGS. 1 and 8, the dusts (D) exhausted through the outlet pipe 105 of the cyclone separator 100 are removed by filtering (S19). Specifically, if the air blower 119 of the dust collector 110 is operated to generate a vacuum pressure, the dusts (D) exhausted through the outlet pip 105 of the cyclone separator 100 are supplied to the chamber 112 through the dust pipeline 115 and the inlet opening 113 and then filtered out by means of the filters 118. In the event that the filters 118 are clogged by the dusts (D), the air compressor 131 of the air blaster 130 is operated to generate a compressed air which in turn is supplied to the nozzle 133 through the air pipeline 132. The dusts (D) adhered to the filters 118 are detached by the compressed air injected from the nozzles 133. The dusts (D) are then discharged through the outlet opening 114 and collected in the dust box 120.

Although the present invention has been described in detail above, it should be understood that the foregoing description is illustrative and not restrictive. For example, even though the above description was presented in viewpoint of wafers made of silicon, the present invention may be used to regenerate wafers made of another kinds of semiconductor material such as gallium arsenide and the other compound semiconductor. Thus, those of ordinary skill in the art will appreciate that many obvious modifications can be made to the invention without departing from its spirit or essential characteristics. We claim all modifications and variation coming within the spirit and scope of the following claims.

What is claimed is:

1. A system for regenerating a semiconductor wafer having fabricated patterns on a surface thereof, said system comprising:

a mesh conveyor for transporting the semiconductor wafer in a condition that the patterns are faced in an upward direction;

a grit blaster installed above said mesh conveyor and having at least one blasting nozzle for blasting grits toward the surface of the semiconductor wafer to remove the patterns from the semiconductor wafer;

means for swinging said blasting nozzle in a plane perpendicular to a transporting path of the semiconductor wafer along said mesh conveyor;

collecting means provided underneath the mesh conveyor for collecting pulverulent bodies including grits, chips, and dusts falling from said mesh conveyor;

separating means connected to said collecting means for separating the grits and chips from the dusts;

a dust collector connected to said separating means for collecting the dusts separated by said separating means; and a destacker for consecutively loading the semiconductor wafer one after another onto an upstream side of the mesh conveyor;

wherein said destacker comprises:

a frame provided adjacent to the upstream side of said mesh conveyor;

a stacker mounted on said frame and having a stacking space within which semiconductor wafers are stacked one on top another;

a lifting arrangement provided under said stacker for lifting up the semiconductor wafers stacked in the stacking space of the stacker to bring the uppermost one of the semiconductor wafers into a standby position; and a loader mounted on a top portion of the frame for gripping the uppermost one of the semiconductor wafers placed at the standby position to load on the mesh conveyor.

2. The system as claimed in claim 1, wherein said stacker comprises:

a plurality of support bars provided upright on said frame of said destacker to define the stacking space, the support bars arranged along an imaginary circle at a rear half part of the stacking space with respect to a horizontal center line so that the semiconductor wafers can be loaded from a front side of the stacking space;

a top fixture plate and an intermediate fixture plate respectively affixed to a top portion and an intermediate portion of the support bars; and a table lying above the intermediate fixture plate for carrying the semiconductor wafers stacked one atop above, the table adapted to make sliding movement along the support bars.

3. The system as claimed in claim 2, wherein a plurality of positioning holes are arranged on the top fixture plate and the table in their radial directions and a plurality of positioning bars are fitted through the positioning holes so as to rest make contact with peripheral edges of the semiconductor wafers.

4. The system as claimed in claim 1, wherein said lifting arrangement comprises:

a first air cylinder installed upright on said frame of said destacker and having a cylinder rod attached to an underside of the table; and a first linear motion guide including a pair of mutually confronting guide rails secured to the frame in a spaced-apart relationship and a pair of sliders combined with the guide rails for sliding movement along the guide rails and joined to opposite sides of the table.

5. The system as claimed in claim 1, wherein said loader comprises:

an arm mounted on the frame;

a second air cylinder attached to the arm and having a cylinder rod;

a carriage joined to the cylinder rod of the second air cylinder;

a second linear motion guide including a guide rail mounted on the arm and a slider slidably combined with the guide rail of the second linear motion guide and joined to the carriage; and a vacuum suction unit attached to an underside of the carriage and having a vacuum pad adapted to suck up the uppermost one of the semiconductor wafers positioned at the standby position.

6. The system as claimed in claim 5, further comprising:

an air blaster mounted on the frame for injecting compressed air to ensure that the uppermost one of the semiconductor wafer is separated from a next semiconductor wafer when the vacuum pad sucks up the uppermost one of the semiconductor wafer.

7. The system as claimed in claim 1, further comprising means for baking the semiconductor to remove moisture and a protective film coated on the semiconductor wafer.

8. The system as claimed in claim 7, wherein said baking means comprises:

an oven having a drying chamber and inlet and outlet openings providing access to the drying chamber;

a conveyor for transporting the semiconductor wafer into and out of the drying chamber through the inlet and outlet openings of said oven; and a heater provided within the drying chamber.

9. A method for regenerating a patterned semiconductor wafer having fabricated patterns on a surface thereof, said method comprising the steps of:

(a) baking the semiconductor wafer to clean the surface of the semiconductor wafer;

(b) putting the semiconductor wafer on a mesh conveyor and transporting the semiconductor wafer in a condition that the patterns are faced in an upward direction;

(c) blasting grits onto the surface of the semiconductor wafer to remove the patterns from the semiconductor wafer using a grit blaster having at least one blasting nozzle while swinging the blasting nozzle;

(d) collecting pulverulent bodies including grits, chips, and dusts falling from the mesh conveyor;

(e) separating the grits and chips from the dusts; and (f) recirculating the grits and chips separated from the dusts to the blasting step.

10. The method as claimed in claim 9, wherein, in said step (c), the grits are blasted using at least one blasting nozzle, and the blasting nozzle is swung while the grits are being blasted.

11. The method as claimed in claim 9, further comprising the step of:

after said step (c), injecting compressed air toward the semiconductor wafer to blow off the grits, the chips, and the dusts remaining on the surface of the semiconductor wafer.

12. The method as claimed in claim 9, wherein said step (d) comprises the step of:

filtering out fragments of the semiconductor wafer resulting from the damage of the semiconductor wafer.

13. A system for regenerating a semiconductor wafer having fabricated patterns on a surface thereof, said system comprising:

a mesh conveyor for transporting the semiconductor wafer in a condition that the patterns face upward;

a grit blaster installed above said mesh conveyor and having at least one blasting nozzle for blasting grits toward the surface of the semiconductor wafer to remove the patterns from the semiconductor wafer;

a nozzle swinging element for swinging said blasting nozzle across a transporting path of the semiconductor wafer along said mesh conveyor;

a collecting element provided underneath the mesh conveyor for collecting pulverulent bodies including grits, chips, and dusts falling from said mesh conveyor;

a separating element connected to said collecting element for separating the grits and chips from the dusts;

a dust collector connected to said separating element for collecting the dusts separated by said separating element; and a destacker for loading the semiconductor wafer onto an upstream side of the mesh conveyor;

wherein said destacker comprises:

a frame provided adjacent to the upstream side of said mesh conveyor;

a stacker mounted on said frame and having a stacking space within which semiconductor wafers are stackable one on top another;

a lifting arrangement provided under said stacker for lifting up the semiconductor wafers stacked in the stacking space of the stacker to bring the uppermost one of the semiconductor wafers into a standby position; and a loader mounted on a top portion of the frame for gripping and loading the uppermost one of the semiconductor wafers placed at the standby position on the mesh conveyor.

14. The system as claimed in claim 13, wherein said stacker comprises:

a plurality of support bars provided upright on said frame of said destacker to define the stacking space, the support bars arranged along an imaginary circle at a rear half part of the stacking space with respect to a horizontal center line so that the semiconductor wafers can be loaded from a front side of the stacking space;

a top fixture plate and an intermediate fixture plate respectively affixed to a top portion and an intermediate portion of the support bars; and a table lying above the intermediate fixture plate for carrying the semiconductor wafers stacked one atop above, the table adapted to make sliding movement along the support bars.

15. The system as claimed in claim 14, wherein a plurality of positioning holes are arranged on the top fixture plate and the table in their radial directions and a plurality of positioning bars are fitted through the positioning holes so as to rest make contact with peripheral edges of the semiconductor wafers.

16. The system as claimed in claim 13, wherein said lifting arrangement comprises:

a first air cylinder installed upright on said frame of said destacker and having a cylinder rod attached to an underside of the table; and a first linear motion guide including a pair of mutually confronting guide rails secured to the frame in a spaced-apart relationship and a pair of sliders combined with the guide rails for sliding movement along the guide rails and joined to opposite sides of the table.

17. The system as claimed in claim 13, wherein said loader comprises:

an arm mounted on the frame;

a second air cylinder attached to the arm and having a cylinder rod;

a carriage joined to the cylinder rod of the second air cylinder;

a second linear motion guide including a guide rail mounted on the arm and a slider slidably combined with the guide rail of the second linear motion guide and joined to the carriage; and a vacuum suction unit attached to an underside of the carriage and having a vacuum pad adapted to suck up the uppermost one of the semiconductor wafers positioned at the standby position.

18. The system as claimed in claim 17, further comprising:

an air blaster mounted on the frame for injecting compressed air to ensure that the uppermost one of the semiconductor wafer is separated from a next semiconductor wafer when the vacuum pad sucks up the uppermost one of the semiconductor wafer.

19. The system as claimed in claim 13, further comprising a baking element for baking the semiconductor to remove moisture and a protective film coated on the semiconductor wafer.

20. The system as claimed in claim 19, wherein said baking element comprises:

an oven having a drying chamber and inlet and outlet openings providing access to the drying chamber;

a conveyor for transporting the semiconductor wafer into and out of the drying chamber through the inlet and outlet openings of said oven; and a heater provided within the drying chamber.

* * * * *